US011229920B2

(12) United States Patent
Irwin et al.

(10) Patent No.: US 11,229,920 B2
(45) Date of Patent: Jan. 25, 2022

(54) SHOWERHEAD, SHOWERHEAD FLUID CONCENTRATOR, AND METHOD

(71) Applicant: Jere F. Irwin, Yakima, WA (US)

(72) Inventors: Jere F. Irwin, Yakima, WA (US); Derek W. Ozanich, Selah, WA (US)

(73) Assignee: Jere F. Irwin, Yakima, WA (US)

( * ) Notice: Subject to any disclaimer, the term of this patent is extended or adjusted under 35 U.S.C. 154(b) by 354 days.

(21) Appl. No.: 15/136,710

(22) Filed: Apr. 22, 2016

(65) Prior Publication Data

US 2016/0325293 A1 Nov. 10, 2016

Related U.S. Application Data

(60) Provisional application No. 62/157,334, filed on May 5, 2015.

(51) Int. Cl.

| | |
|---|---|
| ***B05B 1/18*** | (2006.01) |
| ***B05B 1/34*** | (2006.01) |
| ***B05B 3/08*** | (2006.01) |
| ***B05B 3/06*** | (2006.01) |
| ***B05B 1/26*** | (2006.01) |
| *B05B 15/654* | (2018.01) |

(52) U.S. Cl.

CPC ..... *B05B 1/341* (2013.01); *B05B 1/18* (2013.01); *B05B 1/265* (2013.01); *B05B 3/06* (2013.01); *B05B 3/082* (2013.01); *B05B 15/654* (2018.02)

(58) Field of Classification Search

CPC ..... B05B 1/341; B05B 1/18; B05B 1/265; B05B 3/06; B05B 3/082; B05B 15/654

USPC ..... 239/11, 428.5, 383

See application file for complete search history.

(56) References Cited

U.S. PATENT DOCUMENTS

| | | | | |
|---|---|---|---|---|
| 739,927 A | | 9/1903 | Rennerfelt | |
| 2,419,365 A | | 4/1947 | Nagel | |
| 3,485,451 A | * | 12/1969 | Gore | B05B 3/0427 239/383 |
| 3,801,018 A | | 4/1974 | Plotz | |

(Continued)

FOREIGN PATENT DOCUMENTS

| | | |
|---|---|---|
| WO | WO PCT/US2016/030830 | 8/2016 |
| WO | WO PCT/US2016/030830 | 11/2017 |

OTHER PUBLICATIONS

Awesome Inventions. "Telephone Shaped Shower Head", http://www.awesomeinventions.com/shop/telephone-shaped-shower-head/, retrieved May 30, 2017.

(Continued)

*Primary Examiner* — Joseph A Greenlund

(74) *Attorney, Agent, or Firm* — Keith D. Grzelak; Wells St. John P.S.

(57) ABSTRACT

A showerhead is provided having a housing, a perforate partition and a nozzle body. The housing has a fluid inlet and a fluid outlet. The perforate partition is provided in the housing between the inlet and the outlet and has at least one peripheral fluid passage communicating with the fluid inlet. Each peripheral fluid passage communicates at a downstream end with an inwardly extending peripheral slot, and each slot communicates at a downstream end with a mixing cavity. The nozzle body is carried by the housing downstream of the mixing cavity and has a compression port at an upstream end and an outlet port at a downstream end in fluid communication with the compression port.

41 Claims, 39 Drawing Sheets

(56) References Cited

U.S. PATENT DOCUMENTS 4,010,899 A * 3/1977 Heitzman ..... B05B 3/04 239/381
4,117,979 A * 10/1978 Lagarelli ..... B05B 1/1681 239/381
4,346,844 A * 8/1982 Harmony ..... B05B 1/1636 239/381
4,579,284 A * 4/1986 Arnold ..... B05B 1/083 239/381
5,356,077 A * 10/1994 Shames ..... B05B 1/1645 239/383
5,381,960 A * 1/1995 Sullivan ..... B05B 3/008 239/222.17
5,397,064 A 3/1995 Heitzman
5,398,872 A * 3/1995 Joubran ..... B05B 1/1654 239/99
5,518,181 A * 5/1996 Shames ..... B05B 1/1609 239/381
5,632,446 A * 5/1997 Krochek ..... B05B 1/1681 239/381
5,823,435 A * 10/1998 Morgan ..... B05B 1/323 239/107
5,862,985 A * 1/1999 Neibrook ..... B05B 3/04 239/99
5,938,123 A * 8/1999 Heitzman ..... B05B 3/04 239/383
6,186,414 B1 * 2/2001 Clearman ..... B05B 3/0486 239/214
6,343,750 B1 * 2/2002 Engel ..... B05B 7/0425 239/463
6,550,695 B1 4/2003 Trent
6,669,115 B2 * 12/2003 Sun ..... B05B 1/265 239/403
7,111,795 B2 9/2006 Thong
D648,825 S 11/2011 Ando et al.
D651,281 S 12/2011 Lobermeier et al.
D652,115 S 1/2012 Wang et al.
D652,482 S 1/2012 Obara et al.
D652,892 S 1/2012 Obara et al.
D652,893 S 1/2012 Leung
D653,304 S 1/2012 Obara et al.
D659,796 S 5/2012 Farley
D659,797 S 5/2012 Farley
D665,050 S 8/2012 Kulig et al.
D665,478 S 8/2012 Farley
D666,010 S 8/2012 Farley
D667,078 S 9/2012 Rodney
D670,358 S 11/2012 Bai
D670,359 S 11/2012 Bai
D674,038 S 1/2013 Mendoza et al.
D675,709 S 2/2013 Mendoza et al.
8,376,248 B2 2/2013 Meisner et al.
D683,813 S 6/2013 Erli
D687,924 S 8/2013 Newson
8,517,287 B2 * 8/2013 Zhou ..... B05B 3/04 239/383
D689,981 S 9/2013 Bollerod
D694,856 S 12/2013 Madsen
D698,890 S 2/2014 Bollerod
D698,891 S 2/2014 Bollerod
D698,892 S 2/2014 Frost
D698,893 S 2/2014 Bollerod
D698,894 S 2/2014 Bollerod
D698,895 S 2/2014 Bollerod
D699,319 S 2/2014 Bollerod
D700,276 S 2/2014 Bollerod
D700,277 S 2/2014 Bollerod
D700,278 S 2/2014 Bollerod
D700,279 S * 2/2014 Bollerod ..... D23/213
D700,280 S 2/2014 Bollerod
D700,281 S 2/2014 Bollerod
D710,973 S 8/2014 Madsen
D724,180 S 3/2015 Lin
D733,539 S 7/2015 Wu
D736,347 S 8/2015 Tan
D736,348 S 8/2015 Tan
D738,991 S 9/2015 Brodey et al.
D739,495 S 9/2015 Flowers et al.
D749,694 S 2/2016 Madsen
D751,171 S 3/2016 Bahler
D751,172 S 3/2016 Bahler
D800,249 S * 10/2017 Irwin ..... D23/213
2006/0144968 A1 * 7/2006 Lev ..... B05B 3/0427 239/590
2006/0151632 A1 * 7/2006 Larsen ..... B05B 1/265 239/436
2007/0067904 A1 * 3/2007 Moretto ..... B05B 1/3436 4/596
2008/0087746 A1 * 4/2008 Meisner ..... B05B 1/1645 239/436
2008/0156897 A1 * 7/2008 Leber ..... B05B 3/04 239/101
2011/0168810 A1 * 7/2011 Aihara ..... B05B 3/0463 239/451
2011/0215171 A1 * 9/2011 Chen ..... B05B 3/0427 239/237
2014/0110502 A1 * 4/2014 Yu ..... B05B 1/18 239/240
2016/0325293 A1 * 11/2016 Irwin ..... B05B 1/265

OTHER PUBLICATIONS

Toxel.com, "Egg Shaped Shower Concept," Apr. 3, 2010, http://www.toxel.com/inspiration/2010/04/03/egg-shaped-shower-concept/, retrieved May 30, 2017.
Ultrafeel TV, "Spiral Egg Shower By Arina Komarova", Feb. 27, 2010, http://ultrafeel.tv/shower-egg-arina-komarova/, retrieved May 30, 2017.

* cited by examiner

| Water Pressure psi | With Spinner/No Restrictor gallons/min | | Bell Nozzle/No Restrictor gallons/min | | WAXMAN Nozzle | |
|---|---|---|---|---|---|---|
| 68-69-74 | 2.4 (at 68 psi max) | | 2.2 (at 69 psi max) | | 2 (at 74 psi max) | |
| 60 | 2.3 | 0.1 | 1.95 | 0.25 | 1.8 | 0.2 |
| 50 | 2.1 | 0.2 | 1.8 | 0.15 | 1.7 | 0.1 |
| 40 | 1.75 | 0.25 | 1.6 | 0.2 | 1.6 | 0.1 |
| 30 | 1.5 | 0.25 | 1.4 | 0.2 | 1.5 | 0.1 |
| 20 | 1.25 | 0.25 | 1.1 | 0.3 | 1.35 | 0.15 |
| 10 | 0.8 | 0.45 | 0.75 | 0.35 | 1 | 0.35 |

*FIG. 60*

| Nozzle Type | Water Pressure psi | Shower Flow Rate gallons/min |
|---|---|---|
| With Spinner | | |
| No Restrictor | 66 | 2.2 |
| .043dia 5 Hole Restrictor | 74 | 1.9 |
| .043dia 4 Hole Restrictor | 82 | 1.4 |
| .043dia 3 Hole Restrictor | 94 | 1 |
| Bell Nozzle | | |
| No Restrictor | 70 | 2 |
| .043dia 5 Hole Restrictor | 81 | 1.8 |
| .043dia 4 Hole Restrictor | 83 | 1.3 |
| .043dia 3 Hole Restrictor | 95 | 0.9 |

*FIG. 61*

SHOWERHEAD, SHOWERHEAD FLUID CONCENTRATOR, AND METHOD

RELATED PATENT DATA

This application claims priority to U.S. Provisional Patent Application Ser. No. 62/157,334, filed May 5, 2015, entitled, "Showerhead, Showerhead Fluid Concentrator, and Method", the entirety of which is hereby incorporated by reference.

TECHNICAL FIELD

The presently disclosed subject matter pertains to apparatus and methods for dispensing fluid such as water. More particularly, the presently disclosed subject matter relates to apparatus and methods for directing and disbursing water from a showerhead.

BACKGROUND OF THE INVENTION

Techniques are known for distributing water in patterns from a showerhead. However, limited water supplies, drought, and water conservancy efforts make it difficult to realize forceful and effective shower spray. Improvements are therefor needed in how effectively and efficiently water is distributed from a showerhead.

SUMMARY OF THE INVENTION

According to one aspect, a showerhead is provided having a housing, a perforate partition and a nozzle body. The housing has a fluid inlet and a fluid outlet. The perforate partition is provided in the housing between the inlet and the outlet and has at least one peripheral fluid passage communicating with the fluid inlet. Each peripheral fluid passage communicates at a downstream end with an inwardly extending peripheral slot, and each slot communicates at a downstream end with a mixing cavity. The nozzle body is carried by the housing downstream of the mixing cavity and has a compression port at an upstream end and an outlet port at a downstream end in fluid communication with the compression port.

According to another aspect, a showerhead is provided having a housing, a baffle, and a nozzle body. The housing has a fluid inlet and a fluid outlet. The baffle is provided in the housing between the inlet and the outlet having at least one fluid passage extending into the baffle and communicating with the fluid inlet. The at least one passage is configured to communicate with a radially inwardly extending fluid passage that communicates at an outlet end with a mixing cavity. The nozzle body is carried by the housing downstream of the mixing chamber and has a compression stage at an upstream end and a fluid outlet at a downstream end in fluid communication with the upstream end.

According to yet another aspect, a showerhead fluid concentrator is provided having a housing and a baffle. The housing has a fluid inlet and a fluid outlet. The baffle is provided in the housing between the inlet and the outlet and has at least one peripheral fluid passage extending from the fluid inlet to the fluid outlet. The at least one peripheral fluid passage terminates at a downstream end in an inward direction to communicate with a mixing cavity.

According to even another aspect, a method of dispersing bathing water is provided. The method includes: providing a housing having a fluid inlet, a fluid outlet, and a baffle provided in the housing between the inlet and the outlet having at least one peripheral fluid passage that communicates with the inlet and extends through the baffle from the fluid inlet to the fluid outlet and communicates with at least one inwardly extending peripheral passage and terminates in a mixing cavity and a nozzle body downstream of the mixing cavity; delivering a source of water under pressure to the fluid inlet; dispersing the water through at least one peripheral fluid passage and into the at least one inwardly extending peripheral passage; mixing the water in the mixing cavity; compressing the mixed water through an upstream portion of the nozzle body and ejecting the mixed water from the nozzle body via the fluid outlet.

BRIEF DESCRIPTION OF THE DRAWINGS

Preferred embodiments of the disclosure are described below with reference to the following accompanying drawings.

FIG. 60 is a Table of test results detailing water line pressures and flow rates for the embodiments of FIGS. 1-19, FIGS. 46-55, and an exemplary prior art showerhead.

FIG. 61 is a Table of test results detailing water line pressures and flow rates for the embodiments of FIGS. 1-19 and FIGS. 46-55 while incorporating three uniquely different flow restrictor plates.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

Figure 1:
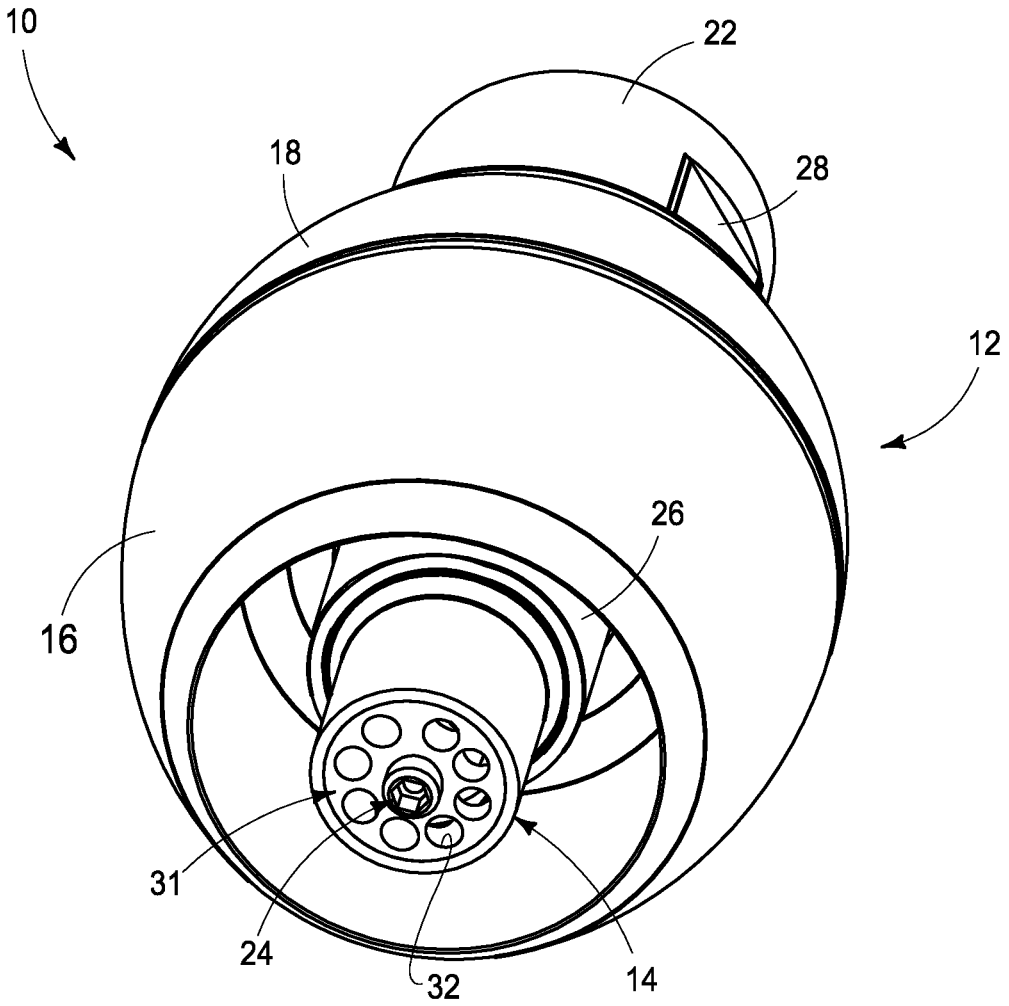
FIG. 1 is a perspective view illustrating a showerhead.

FIG. 1 is a showerhead. FIGS. 1-19 illustrate in greater detail the showerhead according to one aspect where a spinner is driven by water leaving a nozzle from a mixing chamber to drive the spinner in rotation so as to eject water through multiple fluid ejecting ports.

Figure 2:
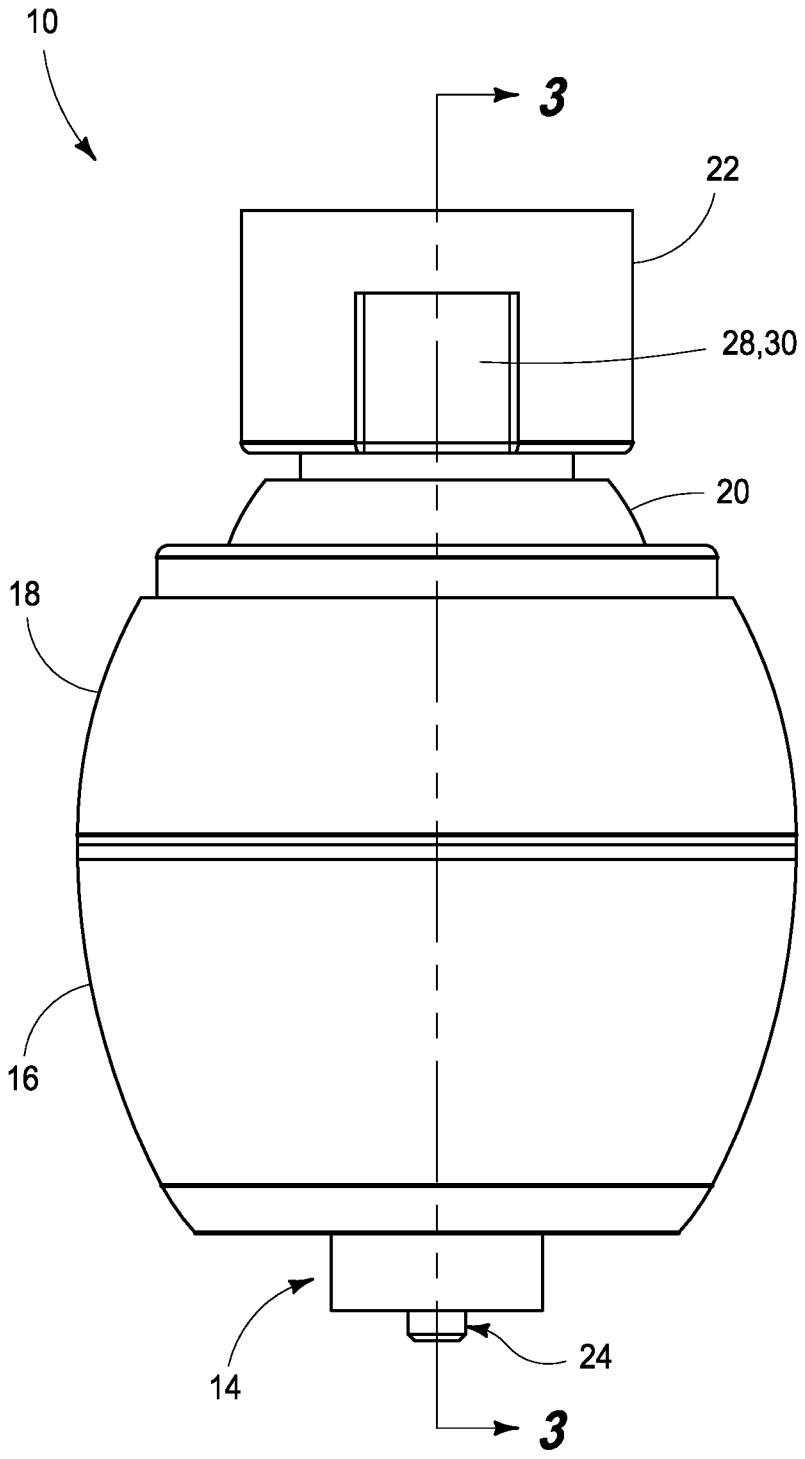
FIG. 2 is a side view of the showerhead of FIG. 1.
Figure 3:
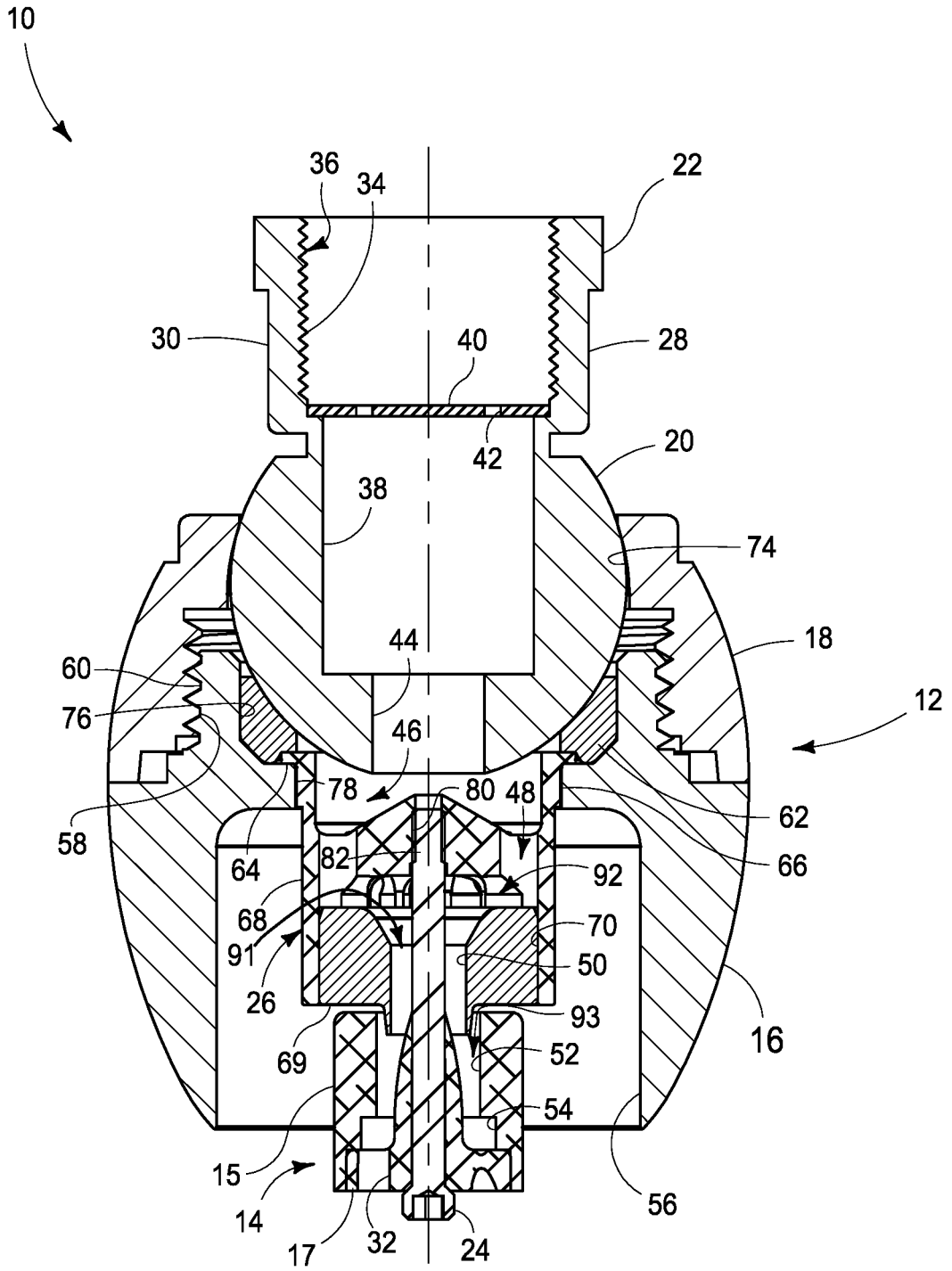
FIG. 3 is a centerline sectional view of the showerhead of FIGS. 1 and 2 taken along line 3-3 of FIG. 2.

FIG. 1 illustrates a showerhead assembly 10 having a pod-shaped bell assembly, or housing 12 with a water emitting rotor, or spinner 14, according to one implementation. Bell housing, or tubular body 12 includes a bell 16 that is secured onto a bell retainer 18. Bell assembly 12 is captured for pivotal repositioning about a ball end fitting 20, as shown in FIGS. 2 and 3. An array 31 of outlet apertures, or ports, 32 on rotor 14 emit water at an outlet end of showerhead assembly 10 as rotor 14 is driven to spin about a retaining fastener 24. Spinning action of rotor 14 is imparted by ejection of fluid, or water from ports 32 in one or more of two ways. First, fluid is directed into a swirling motion within a housing, or mixing hub 26 in one of a clockwise and a counterclockwise direction. Second, fluid is mixed centrally within mixing hub 26 and is ejected through fluid ejecting ports 32, at least one of which is angled in a tangential direction to impart spinning to rotor 14. In both cases, mixing hub 26 directs through fluid passages or ports a plurality of distinct, converging fluid jets through individual passages that terminate in a central mixing chamber where the plurality of fluid jets, or passages intermix in an energetic state that is agitated, violent, and chaotic. A spinning whirlpool, or rapidly rotating mass of water is imparted within mixing hub 26 from water being ejected under pressure via ports 32. According to the implementation of showerhead assembly 10, spinning action of rotor 14 is imparted by both swirling and angled fluid ejection.

Figure 1A:
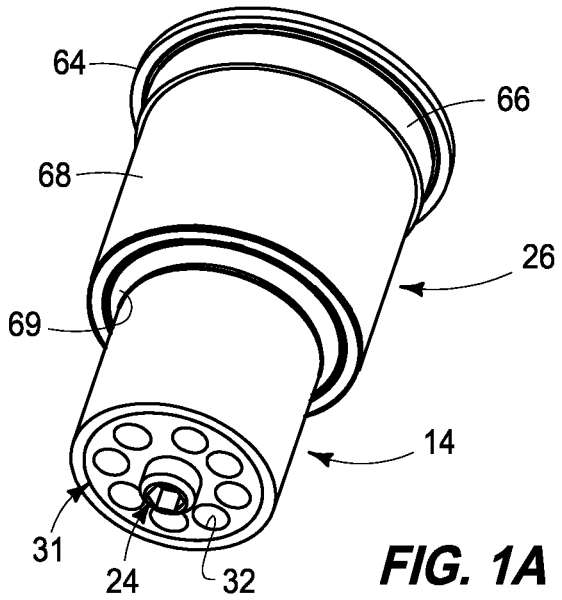
FIG. 1A is a component perspective view of a fluid hub and rotor assembly from the showerhead of FIG. 1.

FIG. 1A illustrates mixing hub 26 and rotor 14 in assembly and removed from showerhead assembly 10 (of FIG. 1). Rotor 14 is carried for rotation by a threaded fastener 24 at a downstream end of mixing hub 26. A threaded end portion 82 on fastener 24 is affixed within a complementarily threaded bore 80 in mixing hub 26. Mixing hub 26 delivers fluid under pressure through a nozzle body 69 into rotor 14, with the fluid being ejected from array 31 of fluid ejecting ports 32 while rotor 14 spins, thereby distributing water with centrifugal force as it is ejected from ports 32. Mixing hub 26 has an outer retaining flange 64, a cylindrical outer seating surface 66, and a cylindrical outer surface 68.

As shown in FIG. 2, ball end 20 is integrally formed at a downstream end of a ball end mount 22 which is used to mount showerhead assembly 10 in fluid sealed relation to a threaded pipe fitting installed in a shower or wash area. Bell 16 and bell retainer 18 are assembled about ball end mount 22. Ball end mount 22 includes a pair of flat tool surfaces 28 and 30 provided on opposite sides of mount 22, in opposed parallel relationship. Tool surfaces 28 and 30 are provided to receive a wrench when threading and unthreading showerhead assembly 10 from an outlet pipefitting. Rotor 14 is secured for rotation by fastener 24 to showerhead assembly 10.

FIG. 3 is a vertical centerline sectional view of the showerhead assembly 10 of FIGS. 1 and 2. An inlet fitting, or connector portion 34 is formed in ball end mount 22 of showerhead assembly 10 at an upstream end comprising a cylindrical female threaded portion 36. Flats 28 and 30 are spaced apart to receive a wrench when threading portion 36 onto a complementarily threaded male pipe fitting of a water supply line. A diffuser plate 40 is optionally received on a circumferential shelf provided on a transition between portion 34 and a cylindrical inlet bore 38. Water passes under pressure from a source through a plurality of flow restricting apertures 42 in diffuser plate 40 and into cylindrical bore 38. The number and size of apertures 42 in plate 40 can be varied in order to achieve a desired flow restriction. Water exits bore 38 into a reduced diameter bore 44 where it passes under pressure into a toroidal chamber 46 for delivery into and through mixing hub, or housing 26. Reduced diameter bore 44 concentrates and pressurizes water from bore 38 for delivery under pressure into chamber 46. Mixing hub 26 and rotor 14 are mounted coaxially within a cylindrical recess 56 in bell assembly 12.

As shown in FIG. 3, pressurized water enters mixing hub 26 at an inlet end along toroidal chamber 46. Water from chamber 46 is directed in a radial outward direction where it enters a plurality of peripheral fluid ports 48 that communicate in an axial direction with a radially-inwardly-extending peripheral slot, or passage (see FIG. 6), each slot communicating at the outlet end with a common, or central mixing cavity 92. Water is then mixed in chamber, or cavity 92 in one of a clock and a counter-clockwise direction. After mixing in chamber 92, water is focused and funneled into a coaxial bore 50 provided in a nozzle body insert 69 where it swirls and accelerates within an annular swirling cavity 91 and is then ejected under pressure from nozzle body 69 in pressurized and swirling configuration that drives rotor, or spinner 14 in rotation about fastener 24. Water is concentrated in a compressing annular cavity 93 formed between bore 52 and rotor insert body 17 that opens into a radially enlarged circumferential, or annular cavity 54 that serves as a backsplash preventer. Water is then delivered from cavity 54 and is ejected through a plurality of fluid ejecting ports 32 while rotor 14 spins, imparting a spinning pattern of streaming water droplets that fan out as a result of centrifugal force.

In assembly, a rotor insert body 17 is press-fit within a complementary rotor housing, or megaphone 15 to form rotor 14. Likewise, nozzle body insert 69 is press-fit within a cylindrical bore 70 of mixing hub 26. Optionally, a small radially inwardly extending lip flange is provided on a downstream end of a cylindrical wall portion 68 and nozzle body insert 69 is forcibly urged into bore 70 past such flange, entrapping nozzle body insert 69 within bore 70. Finally, mixing hub 26 comprises a housing having a radially outwardly extending circumferential lip flange 64, a cylindrical mounting wall portion 66, and cylindrical wall portion 68. A cylindrical bore 78 is sized to receive cylindrical wall portion 66 of mixing hub 26, while flange 64 seats atop and about bore 78. A synthetic rubber gasket 62 is then seated atop flange 64 in a cylindrical gasket seat 76, entrapping and sealing mixing hub 26 within bore 78. Gasket 62 also provides a sealed articulating joint between ball end 20 and bell assembly 12, whereas ball 20 is rotated relative to bell assembly 12 into one of a plurality of desirable angular orientations while gasket 62 seats and seals against ball 20 while retention shoulder 74 retains ball 20 within bell assembly 12.

Bell assembly 12 is formed in two pieces, a bell 16 and a bell retainer 18. Threads 58 on bell retainer 18 couple in complementary threaded engagement with threads 60 on bell 16, enabling assembly and entrapment of ball 20 between seal 62 and retention shoulder 74.

In operation, water is energized as it passes through mixing hub 26, exiting in an energetic, swirling state and is concentrated and further pressurized by passing through a concentrating bore 50 having a frustoconical tapering portion 98 (see FIG. 11) of a nozzle body 69. Water is ejected from bore 50 of nozzle body 69 in a pressurized and swirling state for delivery into an upstream end of a rotor, or spinner 14.

Figure 5:
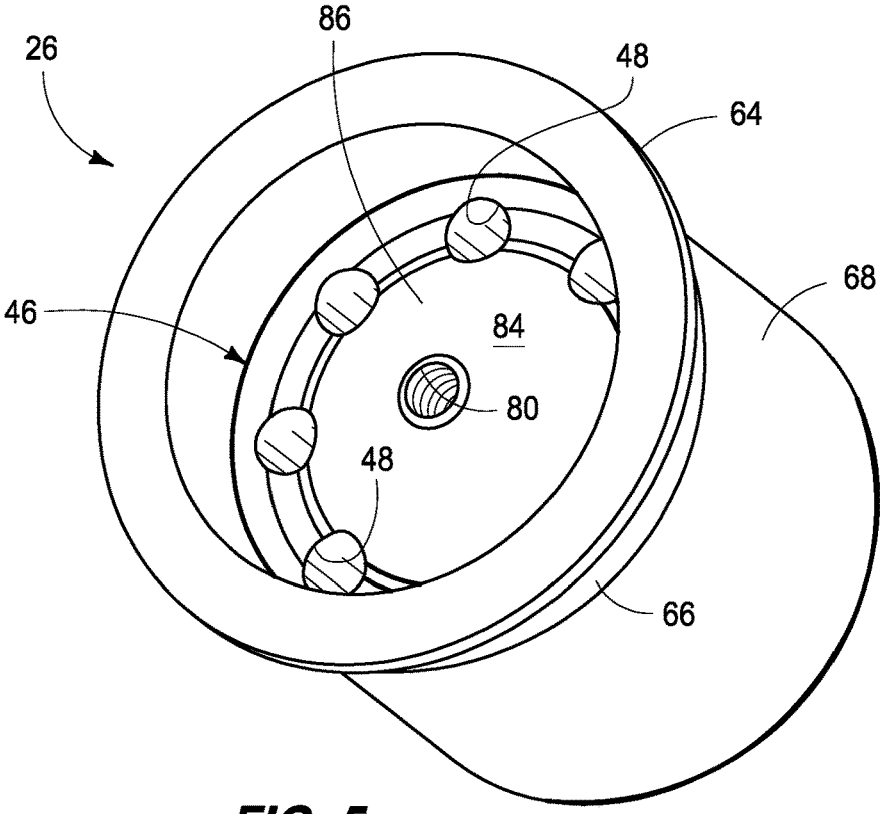
FIG. 5 is a perspective view of a fluid hub from the showerhead of FIGS. 1-4 taken from an upstream end.
Figure 6:
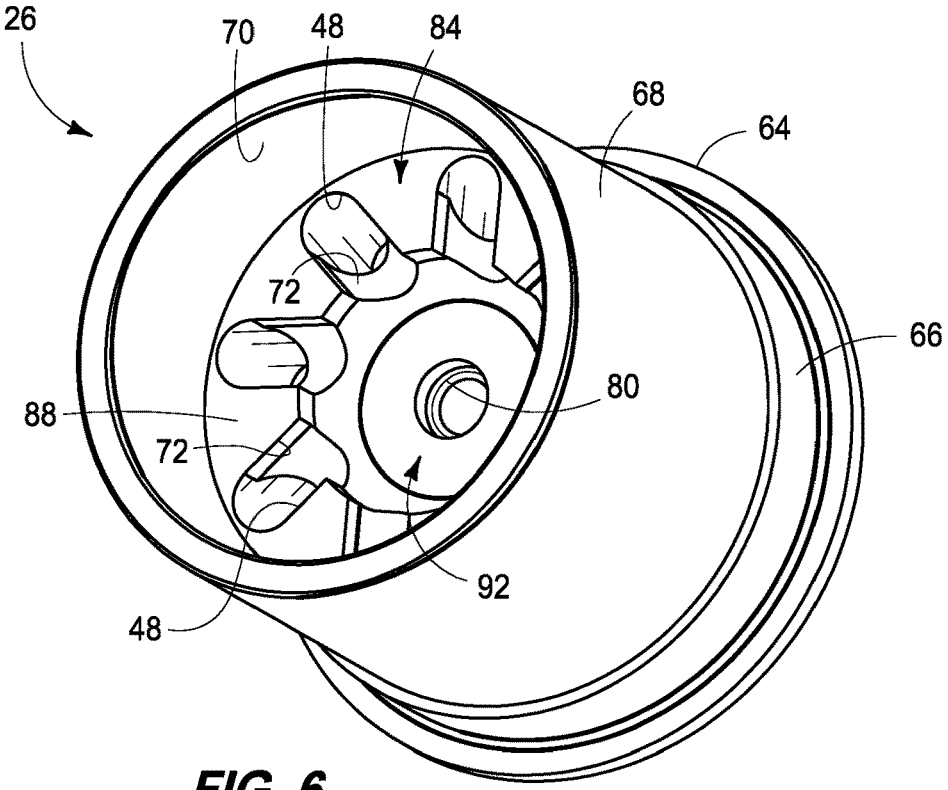
FIG. 6 is a perspective view of a fluid hub from the showerhead of FIGS. 1-4 taken from a downstream end.

FIGS. 5-9 illustrate in detail one exemplary configuration for mixing hub, or housing 26. As shown in FIG. 5, hub 26 has a cylindrical outer wall portion formed at an upstream end by cylindrical flange portion 64, cylindrical wall portion 66, and cylindrical wall portion 68 formed at a downstream end. A conical leading end baffle, or bulkhead 84 is provided inside of, or centrally of cylindrical wall portion 68, and an upstream end of baffle 84 forms a conical inlet surface at the leading end of a center support post, or conical leading end cylindrical post 86 inboard of peripheral slots 72 having a plurality of circumferentially spaced-apart fluid ports, or passages 48 provided along an outer periphery of inlet surface 84 and equidistance from central threaded bore 80. A toroidal chamber 46 is provided upstream of bulkhead 84, within portions 64, 66 and 68. As shown in FIG. 6, baffle 84 is formed within cylindrical wall portion 68 so as to provide bore 70 upstream of baffle 84. Array of fluid ports 48 each communicate with a respective radially inwardly extending peripheral slot 72 formed out of a flat downstream outlet surface 88 of baffle 84 that terminates in a common central mixing cavity, or chamber 92. Flange portion 64 and wall portion 66 are provided upstream of baffle 84, while threaded bore 80 is provided centrally of baffle 84 and coaxially within cylindrical wall portion 68.

Figure 7:
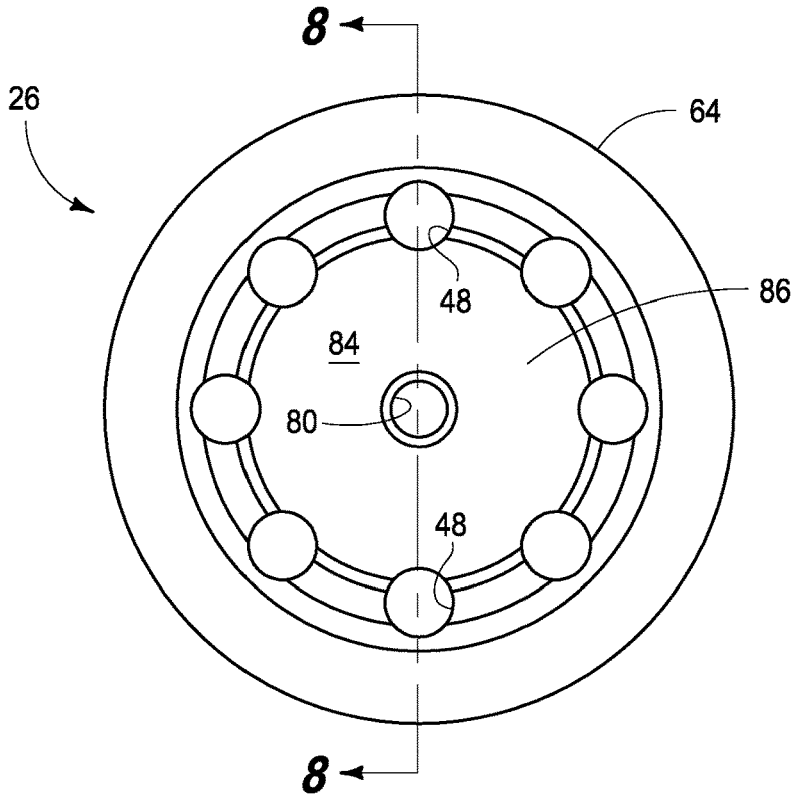
FIG. 7 is an upstream end view of the fluid hub of FIGS. 5-6.

As shown in FIG. 7, a plurality of ports, or fluid passages 48 are provided in mixing hub 26 in an equidistant circumferential array from threaded bore 80 along an outer periphery of baffle 84 such that water is directed outwardly by conical inlet face 86 for passage into each port 48. Flange portion 64 provides an outermost periphery of mixing hub, or housing 26.

Figure 8:
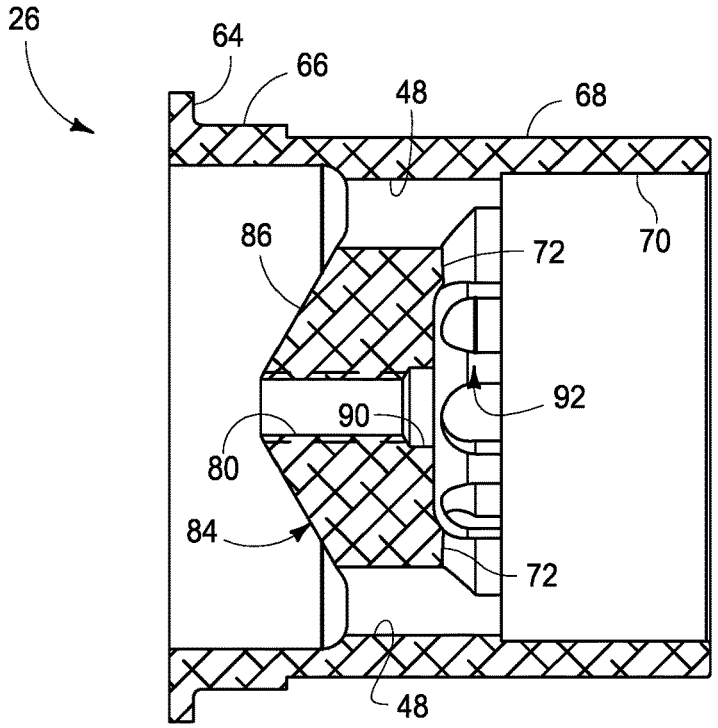
FIG. 8 is a centerline sectional view of the fluid hub taken along line 8-8 of FIG. 7.

FIG. 8 further illustrates hub 26 in center sectional view with flange portion 64, wall portion 66 and wall portion 68 having progressively smaller diameters. Water enters hub 26 from an upstream end and is diverted radially outwardly by conical inlet face 86 of baffle 84 about threaded bore 80 and into ports 48. A shoulder 90 is provided downstream of threaded bore 80 where bore 80 expands in diameter to form a clearance bore. Mixing chamber 92 comprises a surface of revolution mixing chamber having an upstream end portion in the shape of an oblate spheroid.

Figure 9:
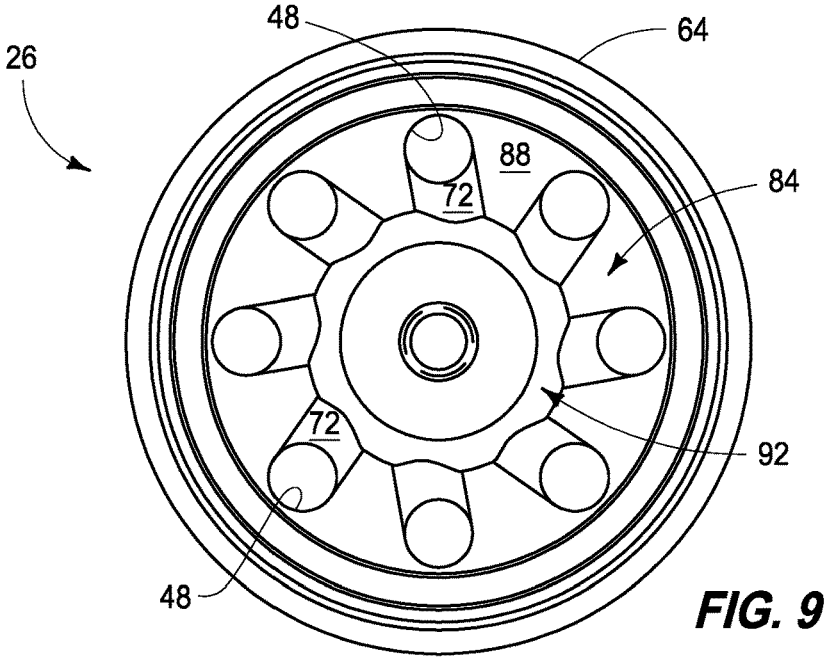
FIG. 9 is a downstream end view of the fluid hub of FIGS. 5-8.

FIG. 9 depicts orientation of the array of passages, or peripheral slots 72 within mixing hub 26 that extend in a generally radially inward direction to impart mixing and swirling of water within central mixing cavity 92. Fluid, or water enters each peripheral slot 72 at a radial outer end from a respective one of fluid passages, or ports 48 at an upstream end of hub 26 proximate flange portion 64. Water is delivered from each port 48 through baffle 84 and into a radially inwardly extending peripheral slot 72 formed into flat outlet face 88 that terminates at a downstream end with a central mixing chamber, or cavity 92. Each peripheral slot 72 extends radially inwardly towards central mixing cavity 92 while also extending at an angle relative to a radial direction in one of a clockwise and a counterclockwise direction. By imparting such angular incline relative the an absolute radial direction, the array of radially extending and circumferentially spaced apart peripheral slots 72 combine to impart fluid swirling and mixing within chamber 92 so as to impart a coherent whirlpool within mixing chamber 92.

Figure 10:
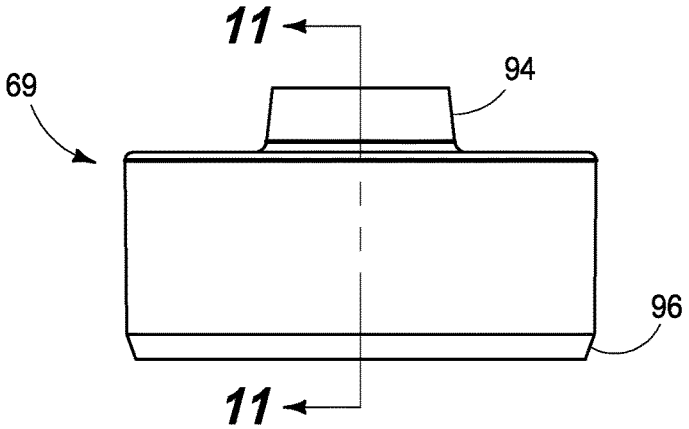
FIG. 10 is a side view of a nozzle body insert used in the showerhead of FIGS. 1-4.
Figure 11:
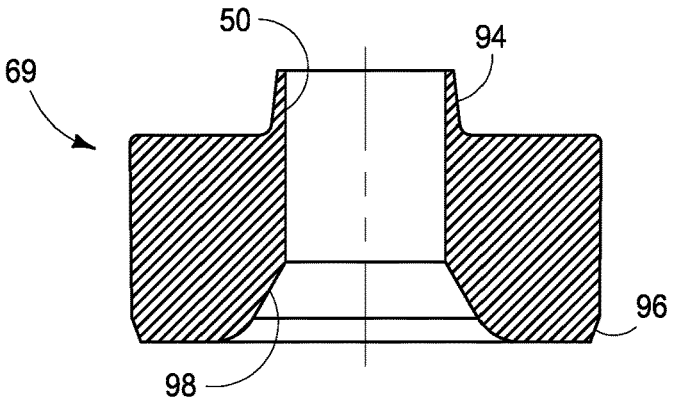
FIG. 11 is a centerline sectional view of the nozzle body insert of FIG. 10 taken along line 11-11 of FIG. 10.

FIGS. 10 and 11 Illustrate one implementation for nozzle body 69, or tubular member. More particularly, nozzle body 69 includes a backsplash preventer flange 94 provided on a downstream end and a leading edge chamfer 96 provided on an upstream edge. As shown in FIG. 11, water enters nozzle body 69 at an upstream end where it is compressed in a tapered frustoconical portion 98 and accelerated into a cylindrical bore 50 for delivery out of a downstream end of bore 50. Nozzle body 69 has an outer diameter sized to be received within bore, or cavity 70 of housing 26 (see FIG. 8) so as to be received in a self-retaining fit-up.

Figure 12:
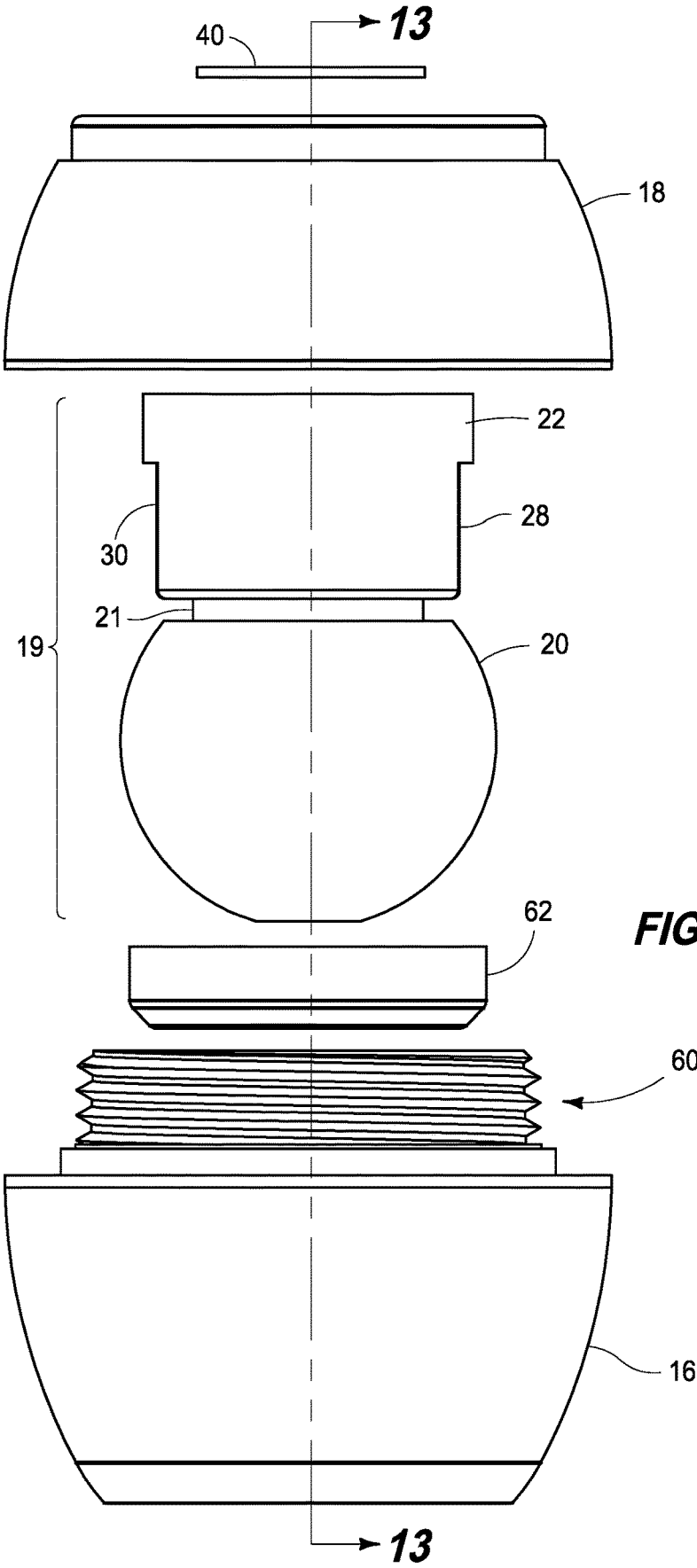
FIG. 12 is an exploded side view with portions removed of the housing components of the showerhead assembly of FIGS. 1-4.
Figure 13:
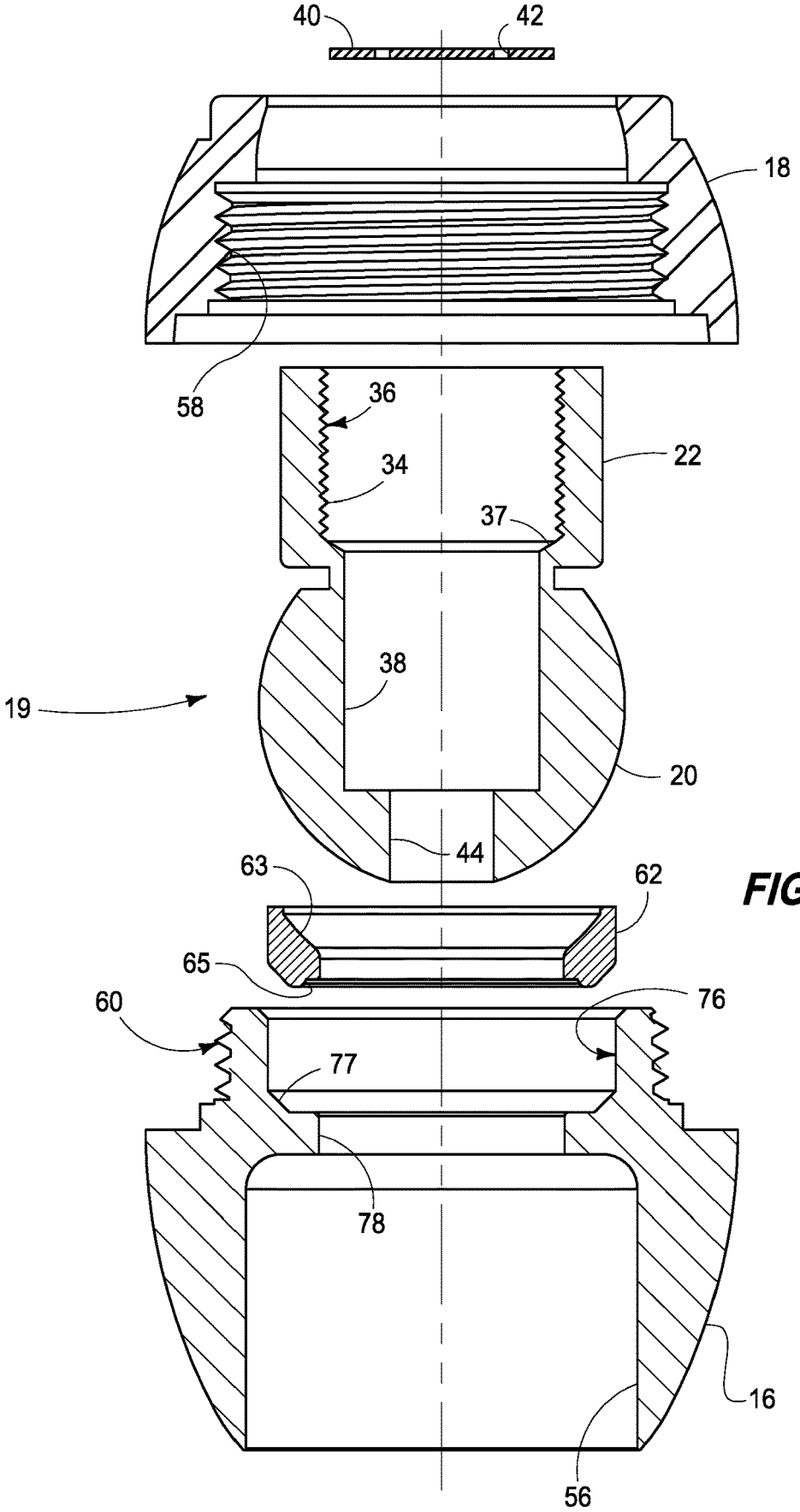
FIG. 13 is a vertical sectional view taken along line 13-13 of FIG. 12.

Assembly details of components for the bell housing and fluid coupler for connecting the showerhead assembly 10 of FIGS. 1-4 are provided in exploded view with the mixing hub and rotor removed in FIGS. 12 and 13. Bell 16 and bell retainer 18 are assembled together with respective threaded portions 60 and 58 to entrap a ball end 20 on a ball end component 19. In assembly, ball end 20 is retained in articulating and sealed engagement with gasket 62, enabling angular adjustment of bell 16 and retainer 18 relative to ball end mount 22 and an associated water supply pipe (not shown) to which it is affixed in sealed relation. Flat surfaces 28 and 30 (see FIG. 12) mate with a wrench when affixing ball end component 19 via threads 36 of connector 34 (see FIG. 13) to a water supply pipe (not shown). One of a plurality of unique diffuser plates 40, each having a unique pattern of apertures (see FIG. 13) and fluid flow rate, is assembled within connector 34 and seated against shelf 37. Ball end mount 22 is set apart from ball end 20 by a radially-inwardly extending circumferential groove 21 (see FIG. 12).

As shown, it is understood that the components depicted in FIGS. 12 and 13 can be constructed from metal, plastic, composite, or chrome-plated metal or plastic, except for gasket 62, which is formed from an elastic material such as rubber, urethane, or some other suitable resilient, sealing material.

As shown in FIG. 13, gasket 62 seats in sealing engagement within a cylindrical gasket seat 76 having a beveled outer circumferential end portion 77. Circumferential groove 65 on gasket 62 is configured in assembly to receive cylindrical flange portion 64 on mixing hub 26 (see FIGS. 3-4) in sealing engagement therebetween. Spherically shaped ball end 20 engages in slidable and sealing relationship with a frustoconical sealing surface 63 on gasket 62. Water is delivered from a supply source through bore 38 into a reduced diameter bore 44 which accelerates the water for delivery into the mixing hub 26 (see FIGS. 3-4) which is received in cylindrical bore 78 within cylindrical recess 56 of bell housing 12 (see FIGS. 3-4).

Figure 14:
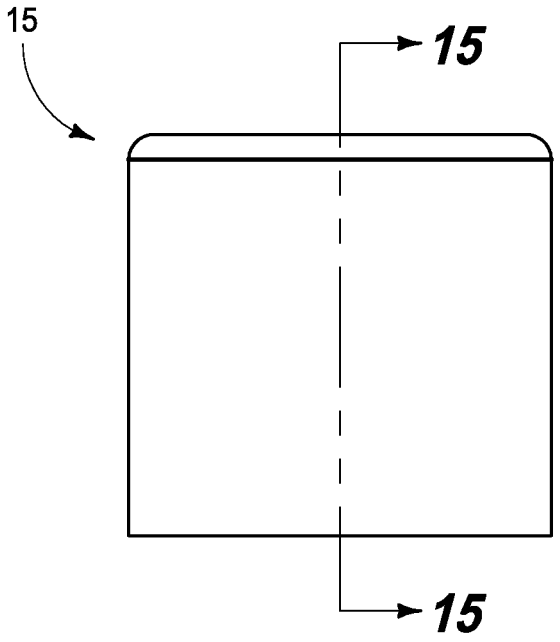
FIG. 14 is a side view of a rotor housing for the showerhead assembly of FIGS. 1-4.
Figure 15:
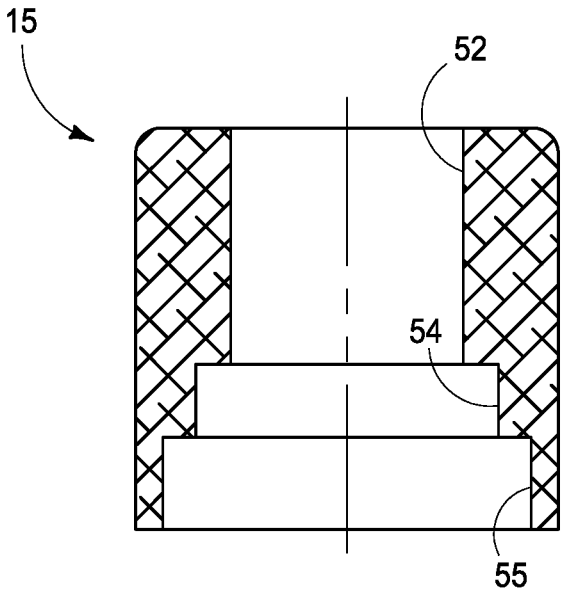
FIG. 15 is a centerline sectional view taken along line 15-15 of FIG. 14.

FIGS. 14 and 15 show details of rotor housing, or megaphone 15. More particularly, housing 15 is a cylindrical housing having a series of progressively larger cylindrical inner bores 52, 54 and 55 extending from an upstream end to a downstream end.

Figure 4:
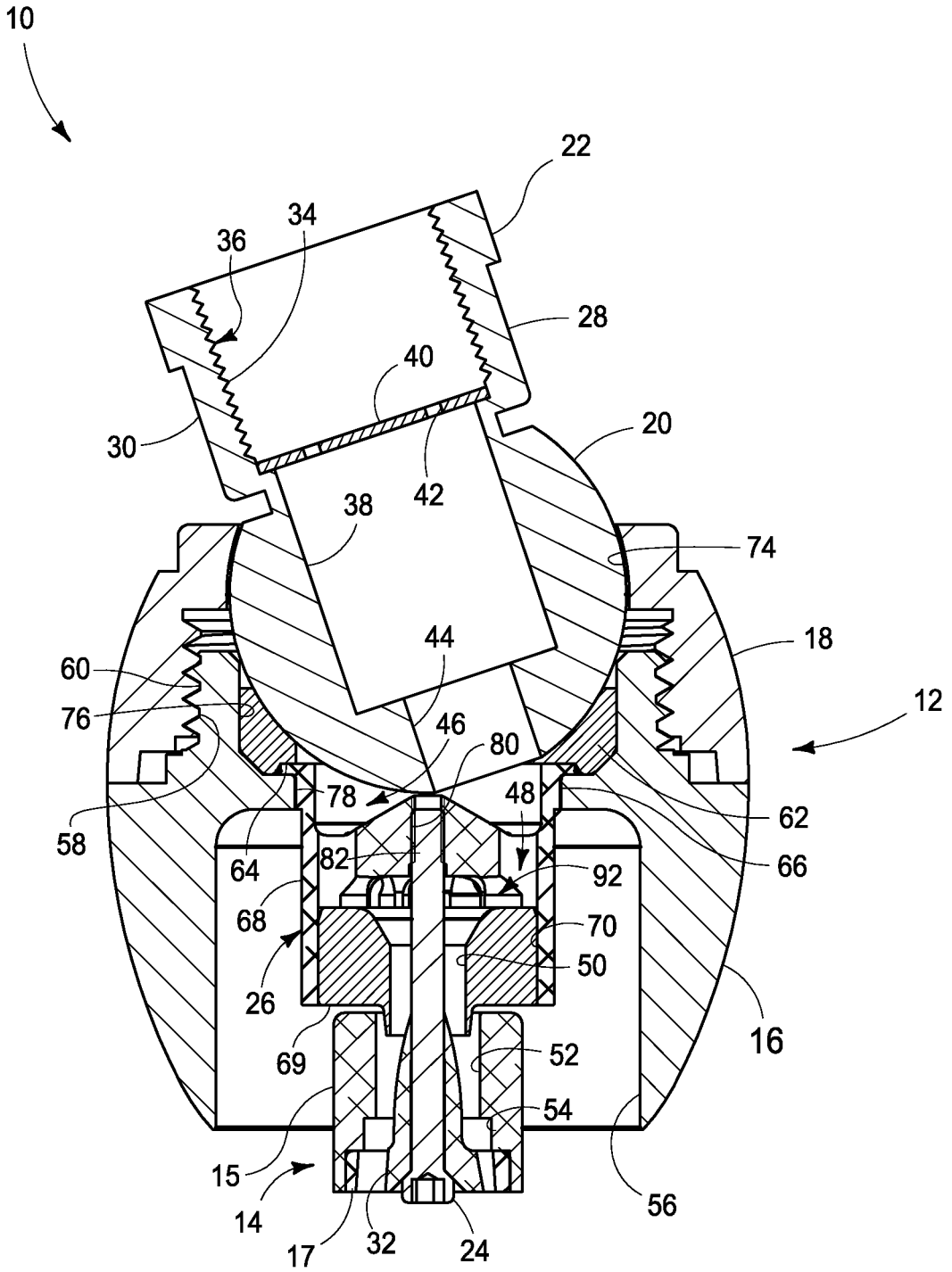
FIG. 4 is a centerline sectional view of the showerhead of FIG. 3 corresponding with the view in FIG. 3 but showing the bell housing assembly articulated to an angled position relative to the ball end mount.
Figure 18:
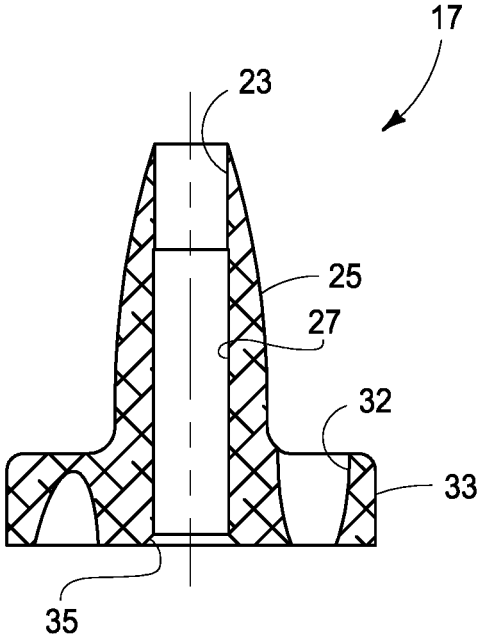
FIG. 18 is a centerline sectional view taken along line 18-18 of FIG. 17.
Figure 19:
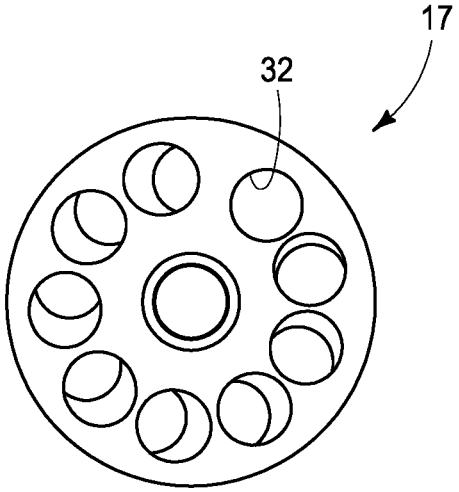
FIG. 19 is a downstream end view of the showerhead rotor of FIGS. 16-18.

FIGS. 16-19 show details of rotor body 17 which is press fit along cylindrical outer peripheral surface 33 into bore 55 (see FIG. 15) while an inner cone 25 extends within and spaced from bores 52 and 54 (see FIGS. 3-4). Bore 54 in assembly provides a circumferential cavity defining a nacellete provided by bore 54 circumferentially about cone 25, as shown in assembly in FIGS. 3 and 4. In one case, bore 54 is provided coaxially about cone 25. Fluid ejecting ports 32 are provided in a circumferential equidistance spaced array about cone 25. As shown in FIG. 19, one port 32 extends parallel to cone 25 while other ports 32 extend at varying angles relative to cone 25 in order to provide varying fluid output angles of water spray from each respective port 32 while rotor body 17 spins with rotor housing 15. Such angles further provide an angled surface that further drives rotor 14 in rotation responsive to water being driven under pressure through such angled ports 32.

Figure 16:
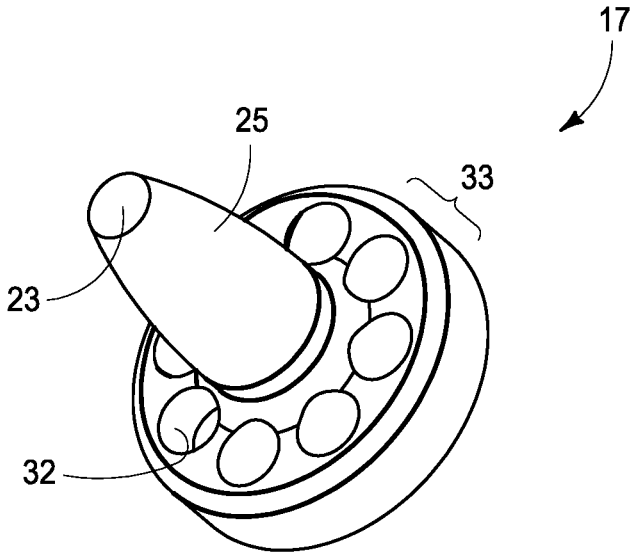
FIG. 16 is a perspective view from an upstream end of a showerhead rotor insert body for the showerhead assembly of FIGS. 1-4.
Figure 17:
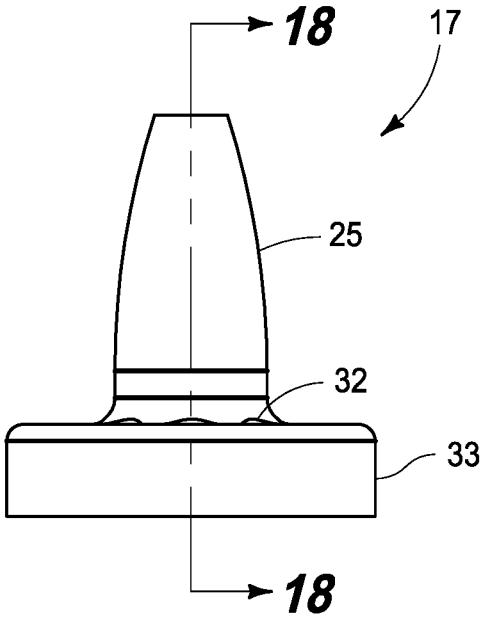
FIG. 17 is a side view of the showerhead rotor of FIG. 16.

FIG. 16 illustrates a bearing surface bore 23 while FIG. 18 shows a transition from bearing surface bore 23 to an expanded clearance bore 27 and a tapered bearing surface 35. In assembly, bearing surface bore 23 and tapered bearing surface 35 cooperate with corresponding surface portions on threaded fastener 24 (see FIGS. 3-4) to provide a rotating bearing surface for rotor 14 as rotor 14 spins in non-contact relation with nozzle body insert 69 (see FIGS. 3-4). Expanded clearance bore 27 serves to reduce contact surface area and friction between rotor 14 and fastener 24 (see FIGS. 3-4).

According to one implementation, rotor insert body 17 is formed from glass impregnated Nylon. Optionally, body 17 is formed from Nylatron®, plastic, composite material, steel, aluminum, brass, bronze, or any other suitable bearing surface and/or structural material. Further optionally, body 17 can be formed with bearing surface inserts in-molded within a plastic or metal material used to form body 17, with bearing insert materials, such as bronze, provided along bearing surface bore 23 and tapered bearing surface 35. Nylatron® is a trade name for a family of nylon plastics, typically filled with molybdenum disulfide lubricant powder, and is a brand name of DSM Engineering Plastics, Inc. of Wilmington, Del., and equity interest of Koninklijke DSM N.V.

In one case, mixing hub 26 and rotor housing 15 (see FIGS. 3-4) are formed from Nylatron®. Optionally, body 17 is formed from Nylatron®, plastic, composite material, steel, aluminum, brass, bronze, or any other suitable structural material.

Figure 20:
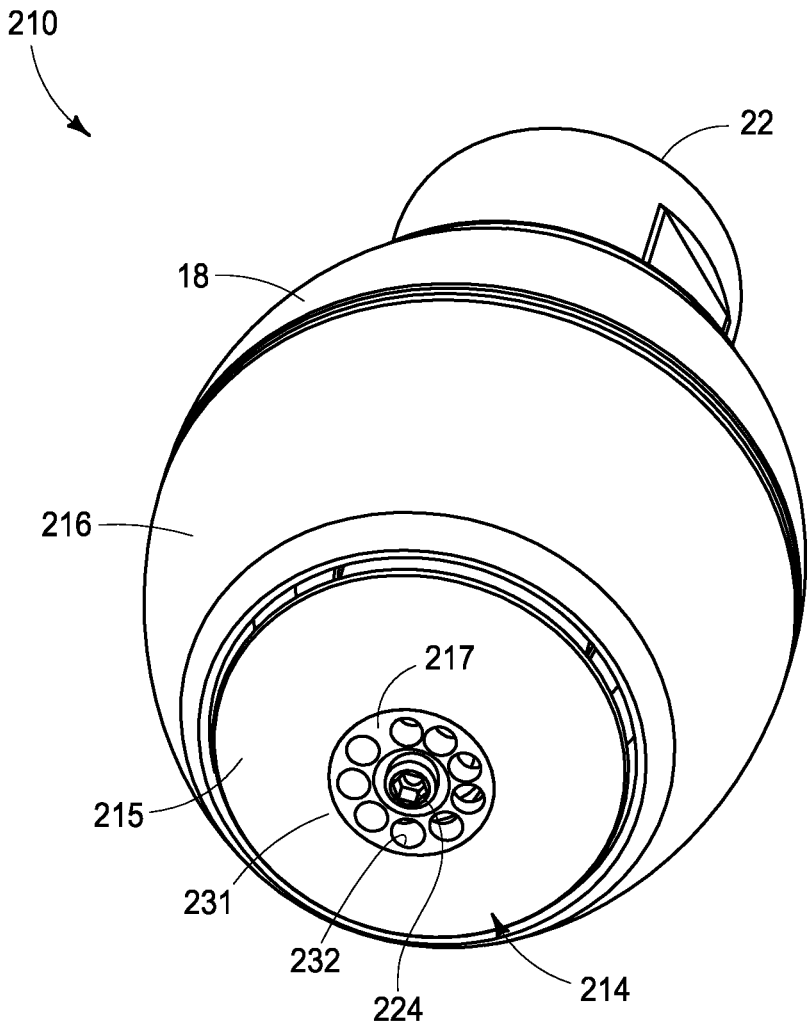
FIG. 20 is a perspective view illustrating another showerhead.

FIGS. 20-25 show details of another showerhead 210. As shown in FIG. 20, showerhead 210 has a rotor, or spinner 214 including a disk-shaped rotor housing 215 and an interchangeable rotor insert 217 carried for rotation by a threaded fastener 224. An array 231 of fluid apertures, or ports 232 are provided in rotor insert 217 of rotor 214 arranged to provide a specific fluid spray pattern from rotor 214 while rotor 214 spins relative to a housing provided by bell 216 and bell retainer 18, and ball end mount 22. It is understood that array 213 of apertures 232 are arranged at different angles and have the same arrangement of angles shown for the apertures depicted in FIG. 19.

Figure 21:
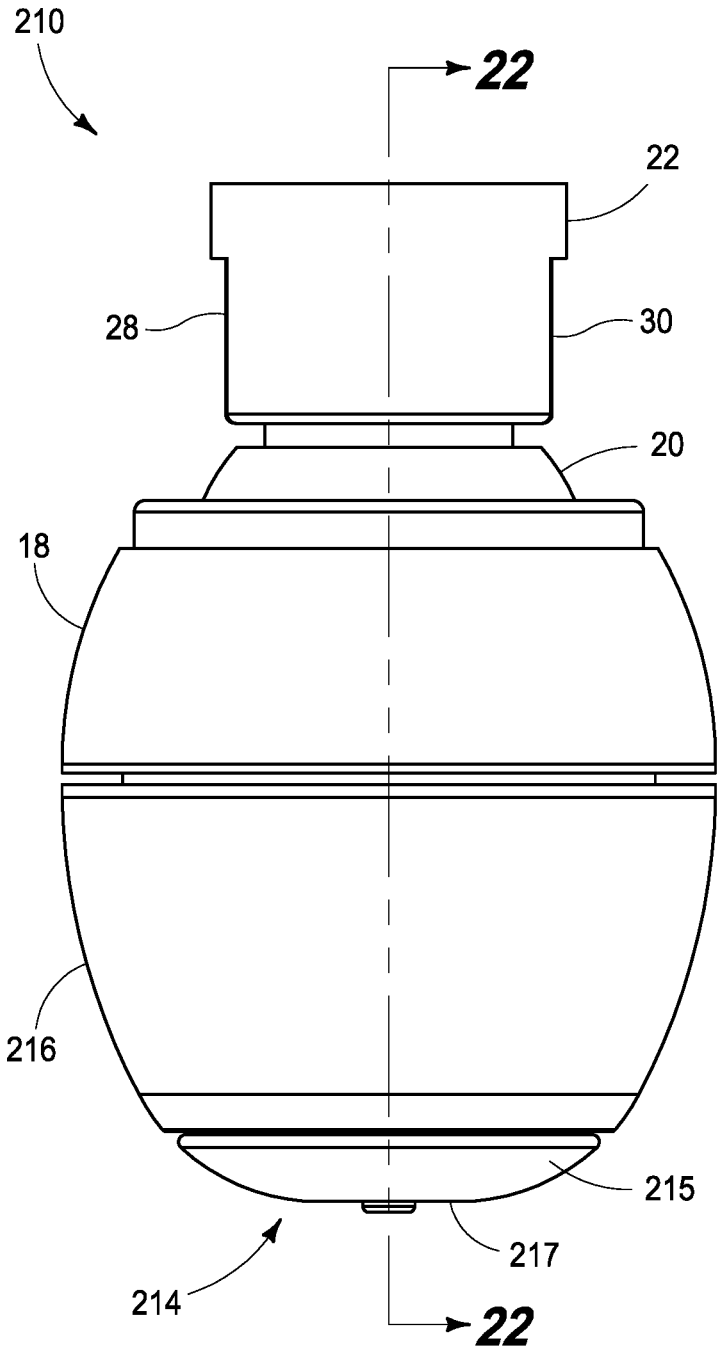
FIG. 21 is a side view of the showerhead of FIG. 20

As shown in FIG. 21, rotor 214 of showerhead 210 has a curved disk-shape that complements an egg-shape of bell 216 and bell retainer 18. In operation, rotor housing 215 and rotor insert 217 are secured together in a press-fit and they rotate responsive to fluid flow imparted against rotor 214. Optionally, the rotor housing and rotor insert can be made as a single part, for example, using three-dimensional printing of parts. Disk-shaped geometry of rotor 214 also imparts a rotational moment of inertial to the rotating rotor 214, which imparts certain spin characteristics to rotor 214. Ball end mount 22 is threaded in sealing engagement with a water supply pipe (not shown) using two flat tool surfaces 28 and 30 and a wrench (not shown), and ball end fitting 20 enables pivoting of bell retainer 18 and bell 216 relative to mount 22.

Figure 22:
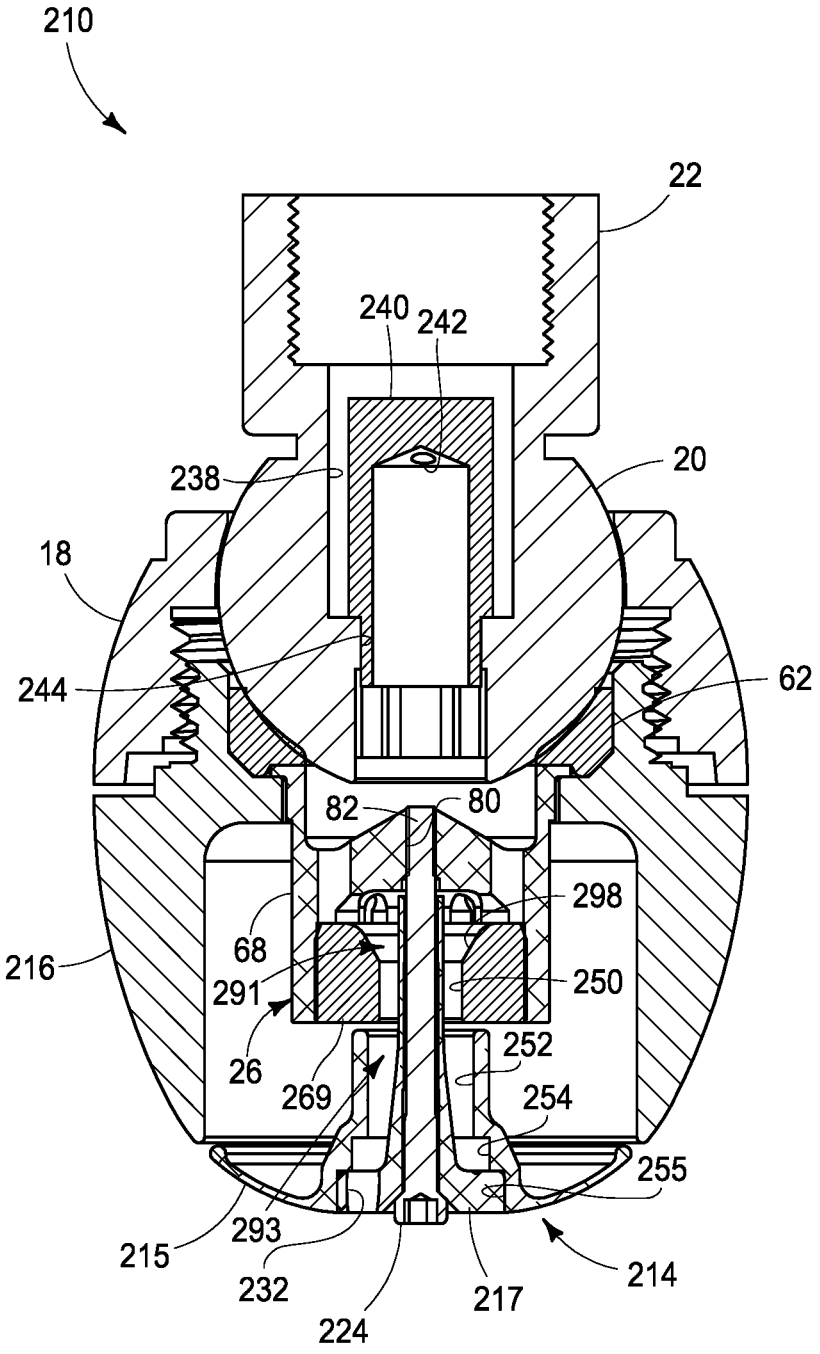
FIG. 22 is a centerline sectional view of the showerhead of FIGS. 20 and 21 taken along line 22-22 of FIG. 21.

FIG. 22 is a centerline sectional view of showerhead 210 illustrating how rotor 214 conformally completes an egg, oval or oblong sphere shape of a housing provided by bell 216 and bell retainer 18. More particularly, rotor 214 is sized in close proximity to an end opening in bell 216 such that no contact occurs between rotor housing 215 and bell 216. Rotor 214 is retained by rotor insert, or hub 217 via a threaded, recessed hexagonal head fastener 224 that is threaded into engagement within a complementary threaded hole in hub 26. Insert 217 has an outer diameter that is press with an interference fit within a cylindrical bore 255 within rotor housing 215. In assembly, rotor 215 is retained axially by an enlarged head of fastener 224 in spaced relation from a nozzle body 269 as press-fit within a wall portion 68 of mixing hub 26.

A tapering stem on rotor insert 217 extends coaxially within bore 254, bore 252, tapered frustoconical portion 298 and the mixing chamber of hub 26, as shown in FIG. 22. In addition, a flow limiting device, or flow restrictor plug 240 is seated centrally within a bore 238 of ball end mount 22. Optionally, plug 240 can be seated in an offset location within a bore provided within ball end mount 22 and it is not necessary that is it provided centrally of mount 22. A plurality of flow ports 242 meter fluid flow through plug 240 and into a downstream cylindrical chamber 280 (see FIG. 25).

In addition to using the above-listed suitable materials for constructing rotor insert 17 (of FIG. 17), rotor insert 217 can be constructed from an Ultra-Wear-Resistant PTFE-Filled Delrin® Acetal Resin. The addition of PTFE to Delrin® acetal resin provides this water-resistant material with a more slippery, wear-resistant surface. Such material is also known as Delrin® acetal resin AF and is catalogued and sold by McMaster-Carr, 9630 Norwalk Blvd., Santa Fe Springs, Calif. 90670-2932.

Figure 23:
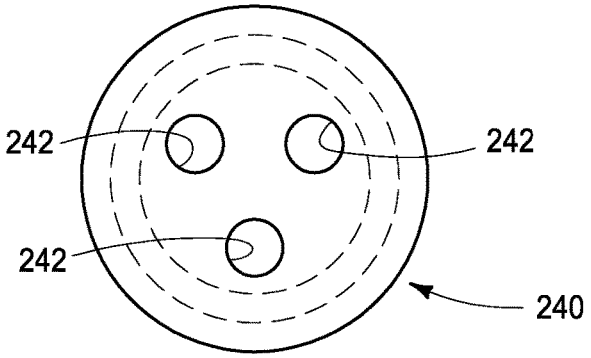
FIG. 23 is a top end inlet view of the flow restrictor plug of FIG. 22.
Figure 24:
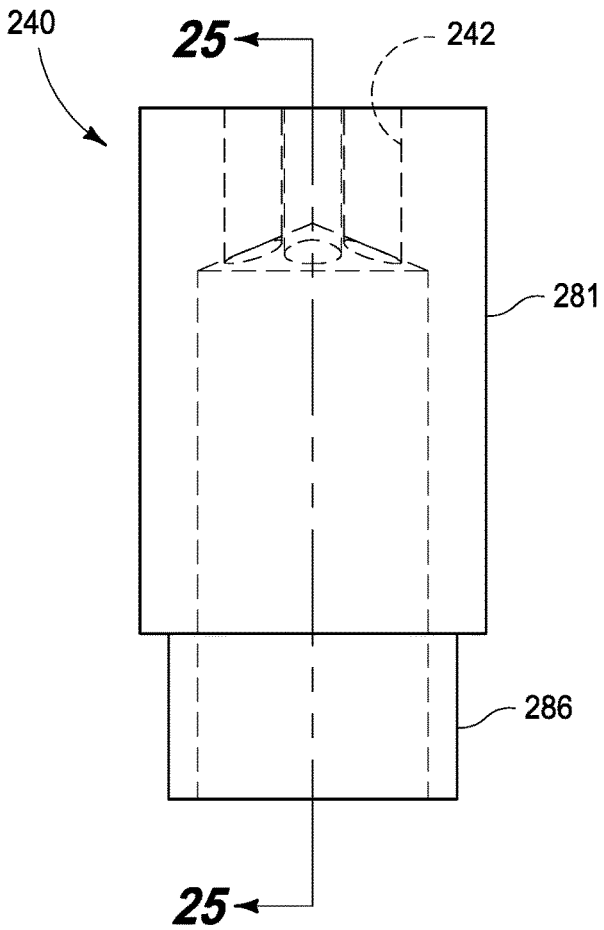
FIG. 24 is a side view of a flow restrictor plug for the showerhead of FIGS. 20-22.
Figure 25:
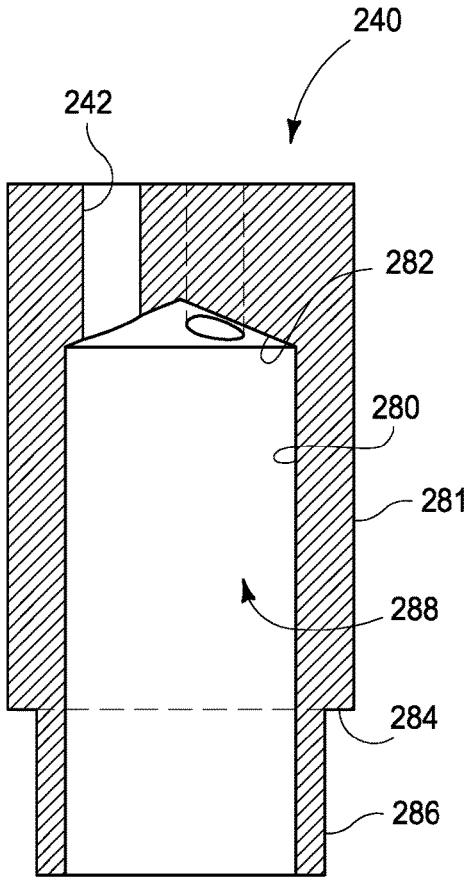
FIG. 25 is a centerline sectional view of the flow restrictor plug taken along line 25-25 of FIG. 24.
Figure 26:
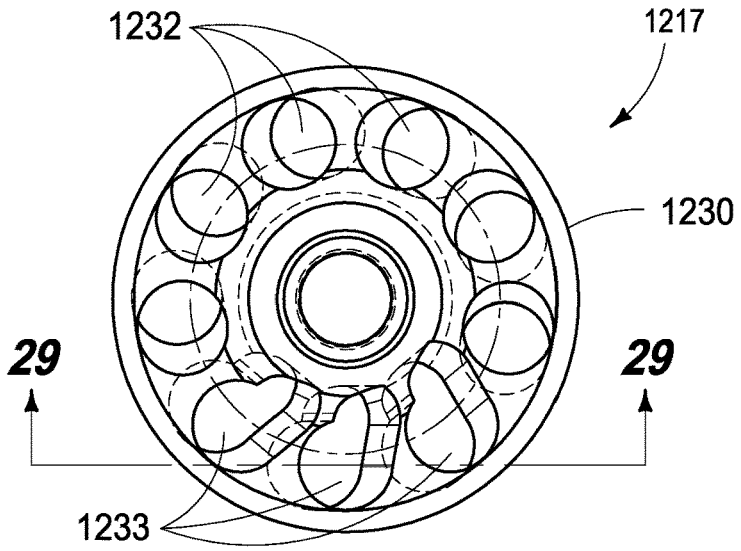
FIG. 26 is a top end view of an alternate rotor for the showerhead of FIG. 20.

As shown in FIGS. 23 and 24, restrictor plug 240 has a circumferentially spaced-apart array of fluid flow ports 242 extending from an upstream end to a common, or central chamber 288 (see FIG. 25) formed by a cylindrical wall portion, or bore 280 and an upper frustoconical chamber head 282. Restrictor plug 240 has an enlarged cylindrical outer wall portion 281 and a reduced diameter ensmalled cylindrical outer wall portion 286, as shown in FIGS. 24 and 25. A circumferential shoulder 284 is formed at the transition point between wall portions 281 and 286, as shown in FIG. 25. wall portion 286 is sized to be received in a force-fit assembly within bore 244 (see FIG. 22).

Apertures 232 of FIGS. 20 and 22 are fed a supply of accelerated and spinning fluid via cylindrical bores 252 and 254 from mixing hub 26. A whirlpool of accelerated and spinning water impinges against entrance end of each aperture 232, acting as a turbine blade and driving rotor 214 to spin. Additionally, angled ejection of fluid from apertures 232 further drives rotor 214 in rotation. Impingement of water at an angle with the entrance end of each aperture on the various rotors disclosed herein imparts break up, spread, dispersion, and segmentation of water flow from each aperture. It is also understood that apertures 232 (and all other apertures disclosed herein) are generally larger than traditional apertures on a showerhead. This feature creates larger drops generally compared to the much smaller drops created by a traditional showerhead having a larger number of smaller apertures, or outlet holes.

In order to work well on low pressure water supply lines, the showerhead uses only 9 relatively large outlet apertures, versus a typical showerhead that has a much larger number of outlet apertures, albeit of substantially smaller size. The provided nine outlet apertures 232 of FIGS. 20 and 22 rotate via rotor, or spinner 214 which serves to further spread water evenly as it is being ejected from rotor 214. Larger size apertures tend to distribute larger water drops than do smaller size apertures. Larger size droplets cool less quickly than do smaller size droplets, thereby providing a warmer shower (for a given amount of supplied hot water). Furthermore, a large number of smaller sized apertures tend to generate steam and fog in a bathroom, while larger droplets from a spinner tend to reduce this effect thereby minimizing the production of steam and fog. Finally, larger apertures are less likely to be clogged by calcium and hard water buildup. Nozzle body 269 is similar to nozzle body 69 (of FIG. 11) but has a modified bore 250 (over extending bore 50 shown in FIG. 11).

In operation, the showerhead 210 of FIGS. 20-22 generates a massage output spray of water. Five successive apertures have a common tilt or angle relative to an outlet face of the rotor 214, which a remaining 4 apertures have progressively smaller angles (or zero angle) apertures. The five apertures with a common angle form a conical spray pattern and the smaller angle apertures aim fluid outlet flow within the conical spray pattern, thereby imparting the feel of a massage spray as the rotor 214 spins. Such conical spray pattern generally has a smaller angle than those generated by traditional showerheads in order to reduce water usage. A massage feel is imparted by interruption of the holes forming the conical spray pattern by holes aimed toward the center of the pattern. Reducing cross-sectional area compression sections, or circumferential central annular cavities 291 and 293 (extending in a downstream flow direction) are provided along insert 217 within nozzle body 209 within hub 26 and rotor 214, respectively.

Although showerheads are shown herein with flow restricting devices, it is understood that such devices can be removed and the showerhead will still work. Additionally, or optionally, the water supply can be restricted at a source to reduce the flow rate, thereby saving water usage while still maintaining a vigorous distribution of water droplets suitable for taking a shower.

FIGS. 26-29 illustrate an optional rotor insert 1217 for the showerhead of FIGS. 20-22. More particularly, as shown in top end view, rotor insert 1217 has an array of progressively changing angled apertures, or fluid ports 1232 similar to the array in rotor insert 217 (of FIG. 22). However, additional non-circular cross-section, or oblong apertures 1233 are also provided in order to impart fluid distribution inside a fluid outlet cone generated by fluid being ejected by remaining apertures 1232. Hence, apertures 1233 on rotor insert 1217 fill the inner spray region left unfilled by fluid being ejected solely from apertures 1232. Circumferential outer surface 1230 is received in assembly within cylindrical bore 255 of showerhead 210 (see FIG. 22) in an alternate assembly.

Figure 27:
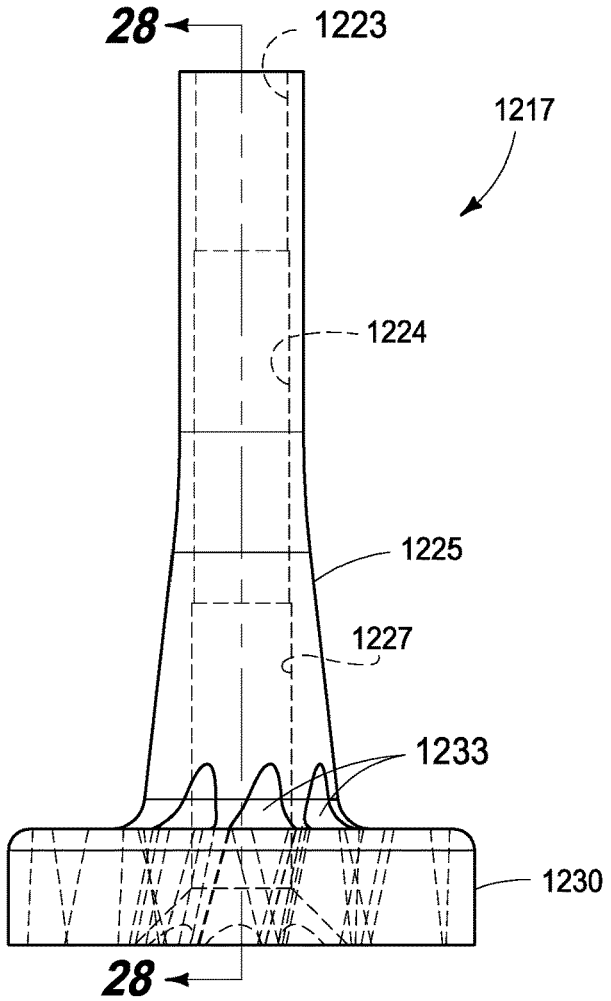
FIG. 27 is a side view of the rotor of FIG. 26.
Figure 27A:
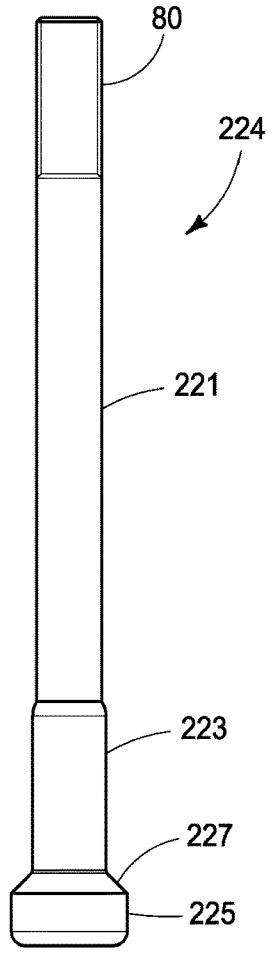
FIG. 27A is a side view of a threaded fastener used to mount the rotor of FIG. 27.
Figure 27B:
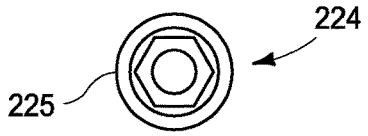
FIG. 27B is an end view of the threaded fastener of FIG. 27A.
Figure 28:
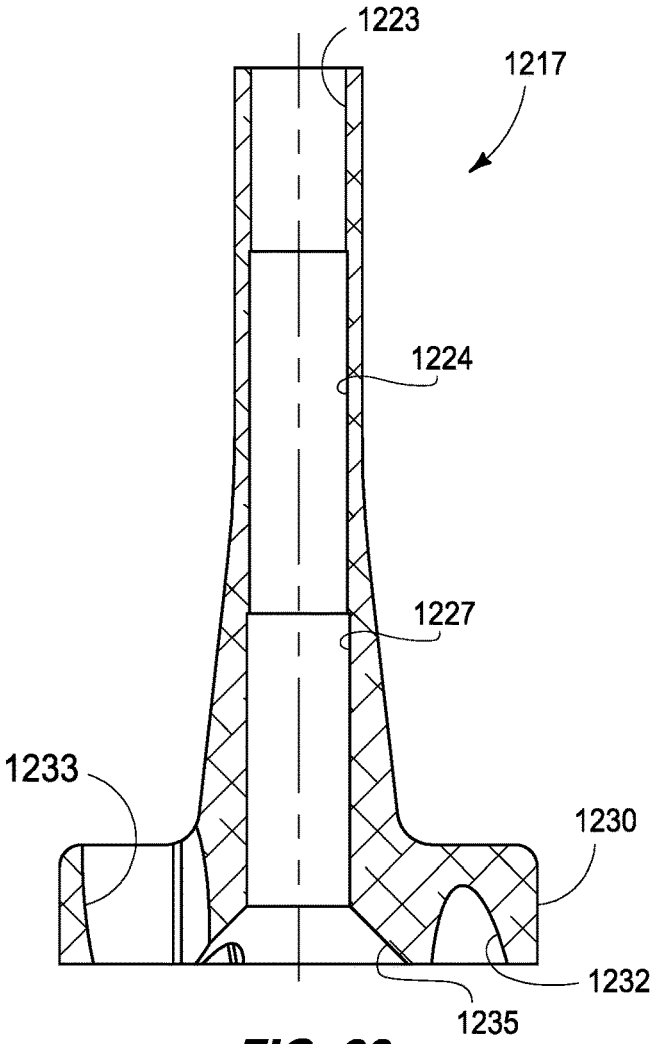
FIG. 28 is a centerline sectional view of the rotor taken along line 28-28 of FIG. 27.
Figure 29:
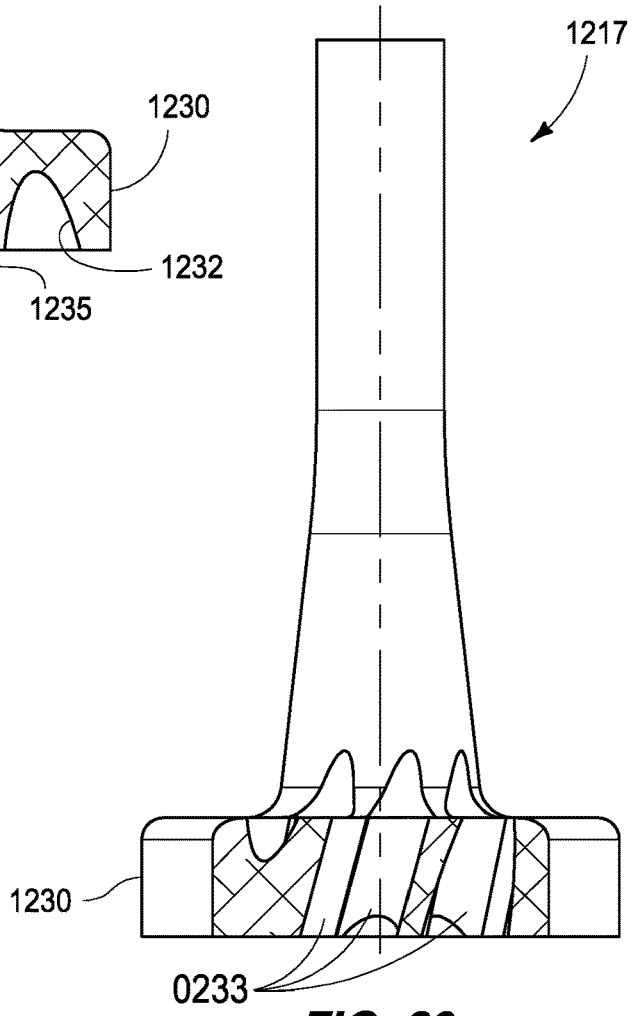
FIG. 29 is a vertical sectional view of the rotor taken along line 29-29 of FIG. 26.

As detailed in FIG. 27, rotor insert, or hub 1217 has a reduced inner diameter bore that forms a bearing surface with fastener 224 (see FIG. 22) having reduced surface area and frictional contact. A remaining contact portion is formed where a head of fastener 224 contacts rotor insert 1217 along frustoconical taper 1235 (see FIG. 28). As shown in FIGS. 27 and 28, rotor insert 1217 has a progressively increasing set of staged bore segments 1223, 1224, and 1227, ending in frustoconical taper 1235 at an opposite end from bore segment 1223. A surrounding outer surface on hub 1217 forms a frustoconical, or tapering outer surface 1225 that is pierced at a widest-most portion, adjacent to enlarged circumferential outer surface 1230, by individual apertures 1233. FIGS. 27A and 27B show details of fastener 224. As shown in FIGS. 28 and 29, apertures 1232 do not pierce surface 1225, but instead are formed solely within enlarged circumferential outer surface 1230.

Fastener 224 of FIG. 27A includes a reduced diameter portion 221 that is sized to form a distal end bearing surface with bore 1223 on rotor 1217 of FIG. 27 (or rotor 217 of FIG. 22). Portion 221 has a distal threaded end portion 80 formed in portion 221 that is threaded into engagement in assembly within a complementary threaded female bore in hub 26 (see FIG. 22). An increased diameter portion 223 is received within complementary bore 1227 of rotor 1217 (or rotor 217 of FIG. 22). A highly polished shoulder 227 on a fastener head 225 of fastener 224 provides a bearing surface for rotor 1217 of FIG. 27 (or rotor 217 of FIG. 22). Finally, FIG. 27B shows fastener 224 having one suitable hex head fastener head 225. Other forms of fastener can optionally be used.

Figure 30:
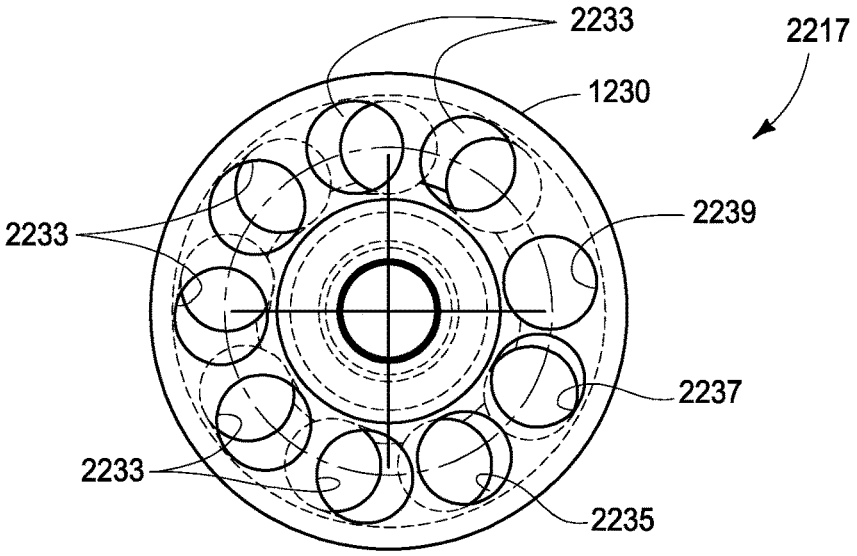
FIG. 30 is a top end view of a second alternate rotor for the showerhead of FIG. 20.
Figure 31:
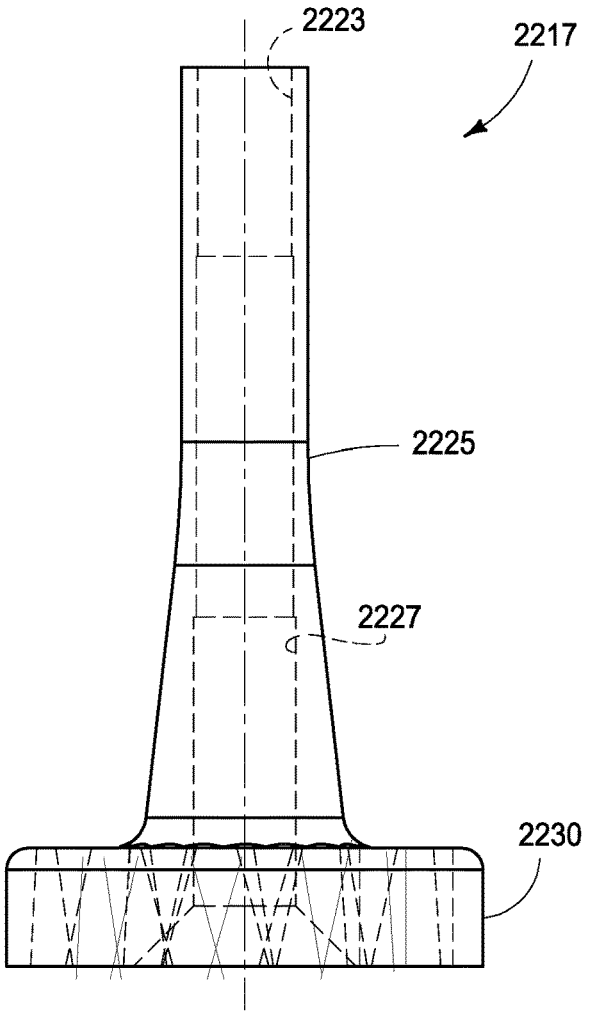
FIG. 31 is a side view of the rotor of FIG. 30.

FIGS. 30 and 31 illustrate another optional rotor for the showerhead of FIG. 20. More particularly, rotor insert 2217 can be substituted for rotor 217 in showerhead assembly 210 of FIGS. 20-22. As shown in FIG. 30, rotor insert 2217 has a circumferential array of fluid apertures, or ports 2233, 2235, 2237, and 2239 provided with a region defined by circumferential tool surface 1230. Apertures 2233, 2235, and 2237 are angled in a direction perpendicular to a radial direction. Apertures 2233 have a greater angle than aperture 2235 and aperture 2235 has a greater angle than aperture 2237. Aperture 2239 has no angle and extends in an axial direction. In operation, fluid ejected from aperture 2237 is designed to intersect fluid that is ejected from aperture 2239, causing fluid to disperse laterally of the impact region, including in a radially inward direction. In this manner, fluid is delivered within a central region of where fluid would other be delivered solely by the directional output from individual apertures 2233, 2235, 2237 and 2239.

Figure 32:
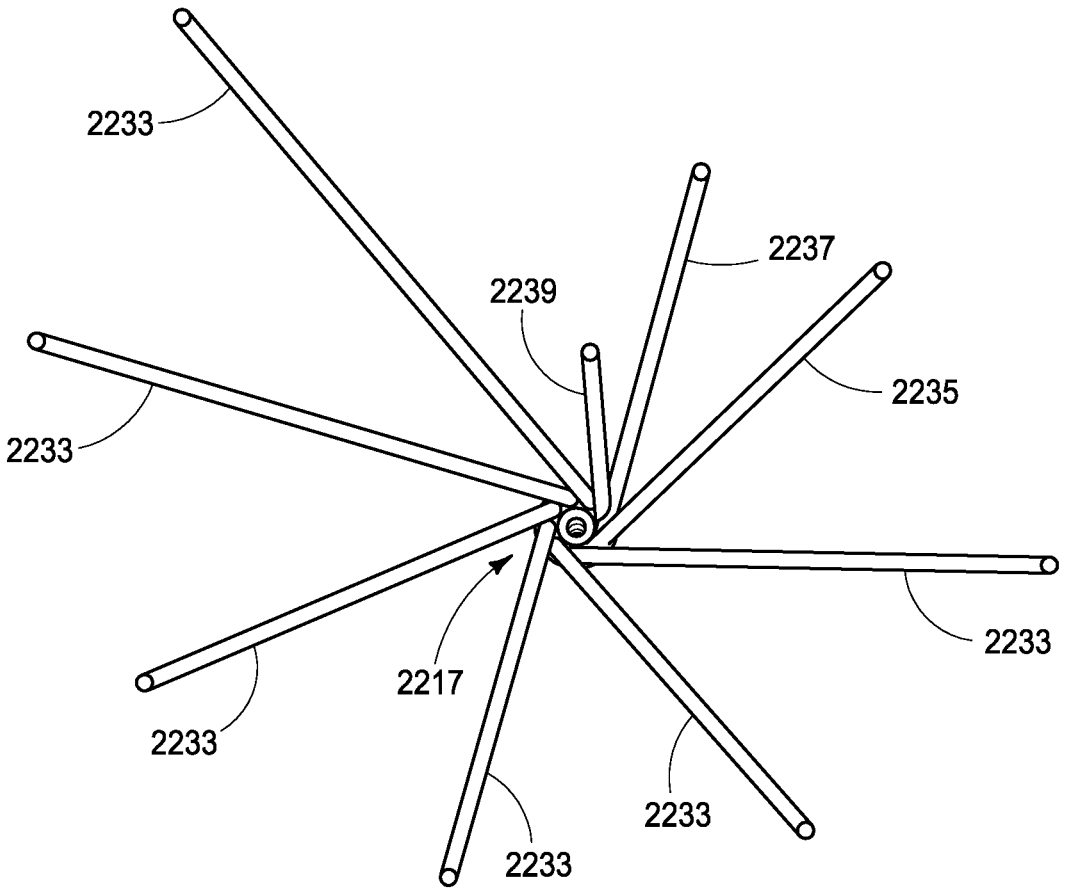
FIG. 32 is a schematic diagram illustrating water flow outlet paths from each port on the spinner of FIGS. 30-31.

FIG. 32 is a schematic diagram illustrating water flow outlet paths from each port on the spinner of FIGS. 30 and 31. Such water flow outlet paths contemplate the effects that centrifugal forces impart on each water flow outlet path. Each water flow outlet path is numbered with the respective aperture from which it originates, showing how the water flow outlet paths from apertures 2237 and 2239 intersect after leaving the rotor insert 2217 of the showerhead. In contrast, the water flow outlet paths from apertures 2233 and 2235 do not collide with any other outlet path, but they define distinctive angular pathways.

Figure 33:
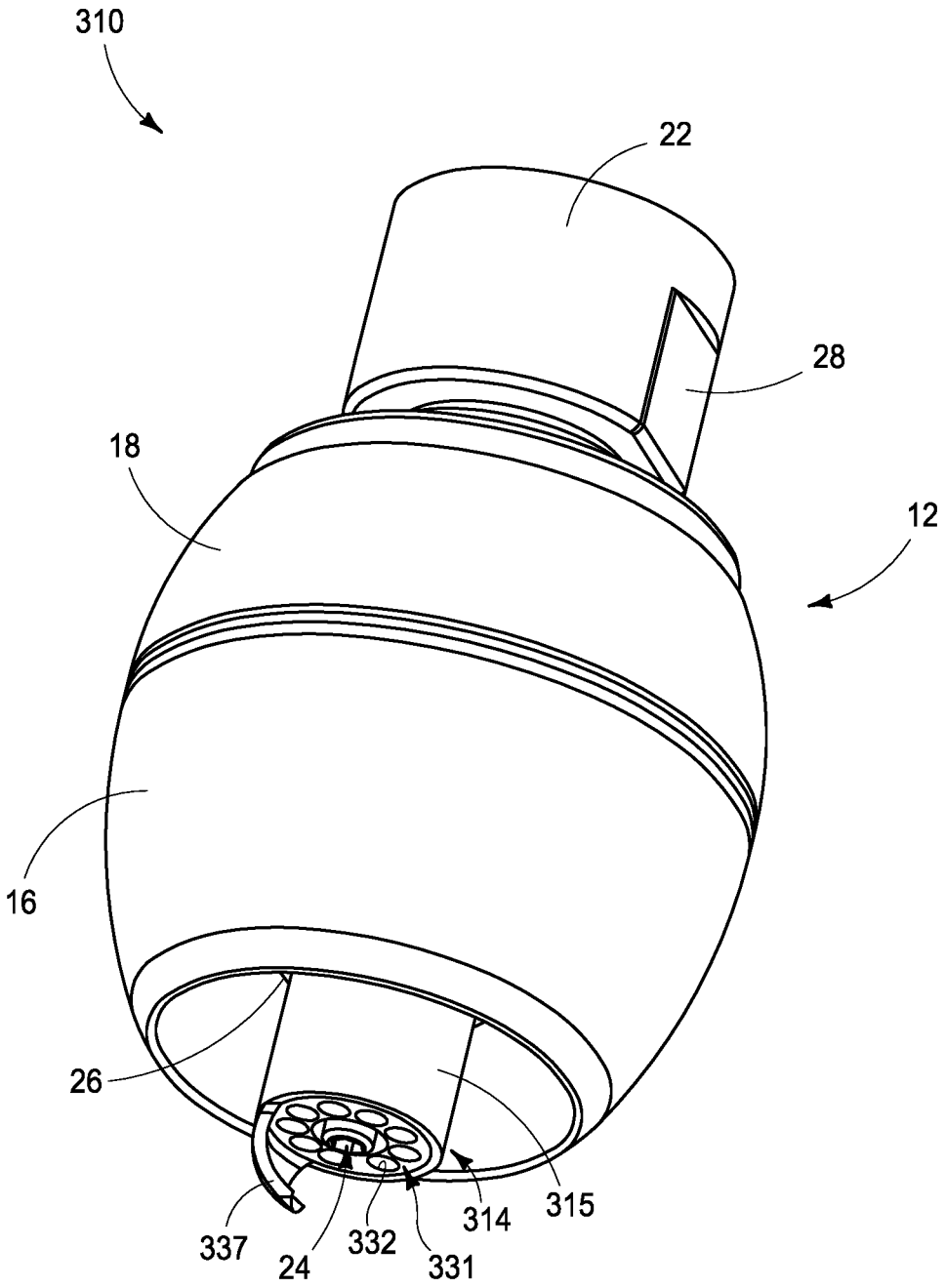
FIG. 33 is a perspective view illustrating yet another showerhead.

FIG. 33 is a perspective view illustrating yet another showerhead 310 having a rotor, or spinner 314 with an array 331 of fluid outlet apertures 332 and an arcuate, inwardly extending fluid deflecting finger 337 configured to deflect fluid from some of apertures 332 to cause fluid to be delivered within a flow path generated solely by apertures 332. Finger 337 is integrally formed from a rotor housing 315. Rotor 314 is affixed via a threaded fastener 24 to mixing hub 26 in a manner similar to previously described embodiments. Showerhead 310 also includes parts common to previously described embodiments including ball end mount 22 with tool surfaces such as surface 28 and housing 12 including bell 16 and bell retainer 18.

Figure 34:
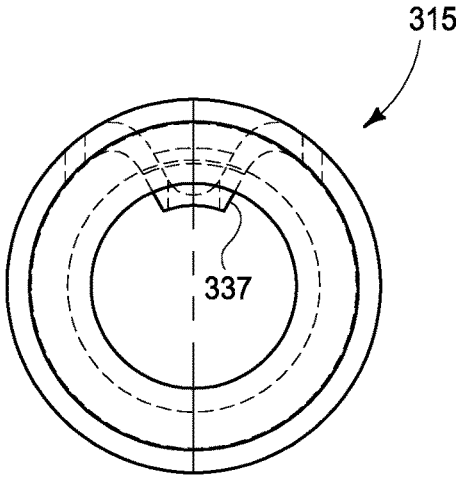
FIG. 34 is a top view of a flow deflecting rotor housing for the showerhead of FIG. 33.
Figure 35:
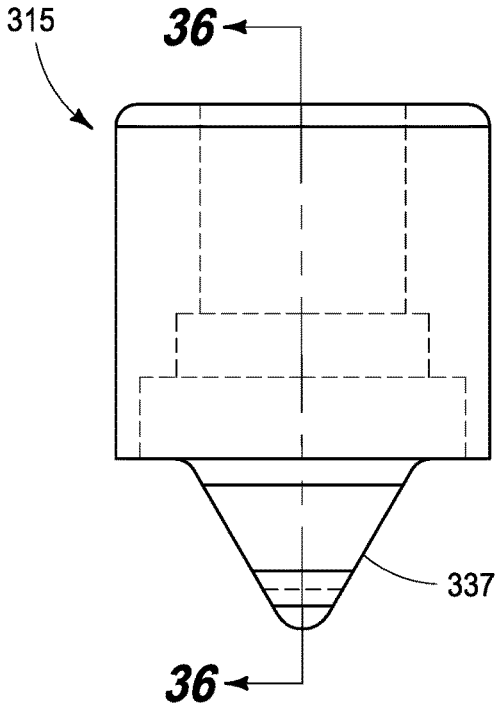
FIG. 35 is a side view of the rotor housing of FIG. 34.
Figure 36:
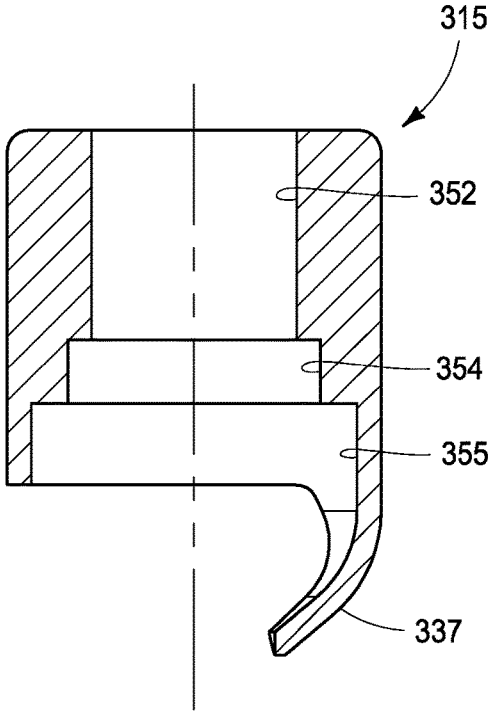
FIG. 36 is a centerline sectional view taken along line 36-36 of FIG. 35.

FIGS. 34-36 illustrate rotor housing 315 including the arcuate, inwardly extending fluid deflecting finger 337. As shown in FIG. 36, a cylindrical bore 355 is sized to receive in press fit a rotor insert (such as rotor insert 217 (of FIG. 22). Cylindrical bores 352 and 354 are analogous to bores 252 and 254 (of FIG. 22) and serve to delivery fluid, or water to apertures in the rotor insert.

Figure 37:
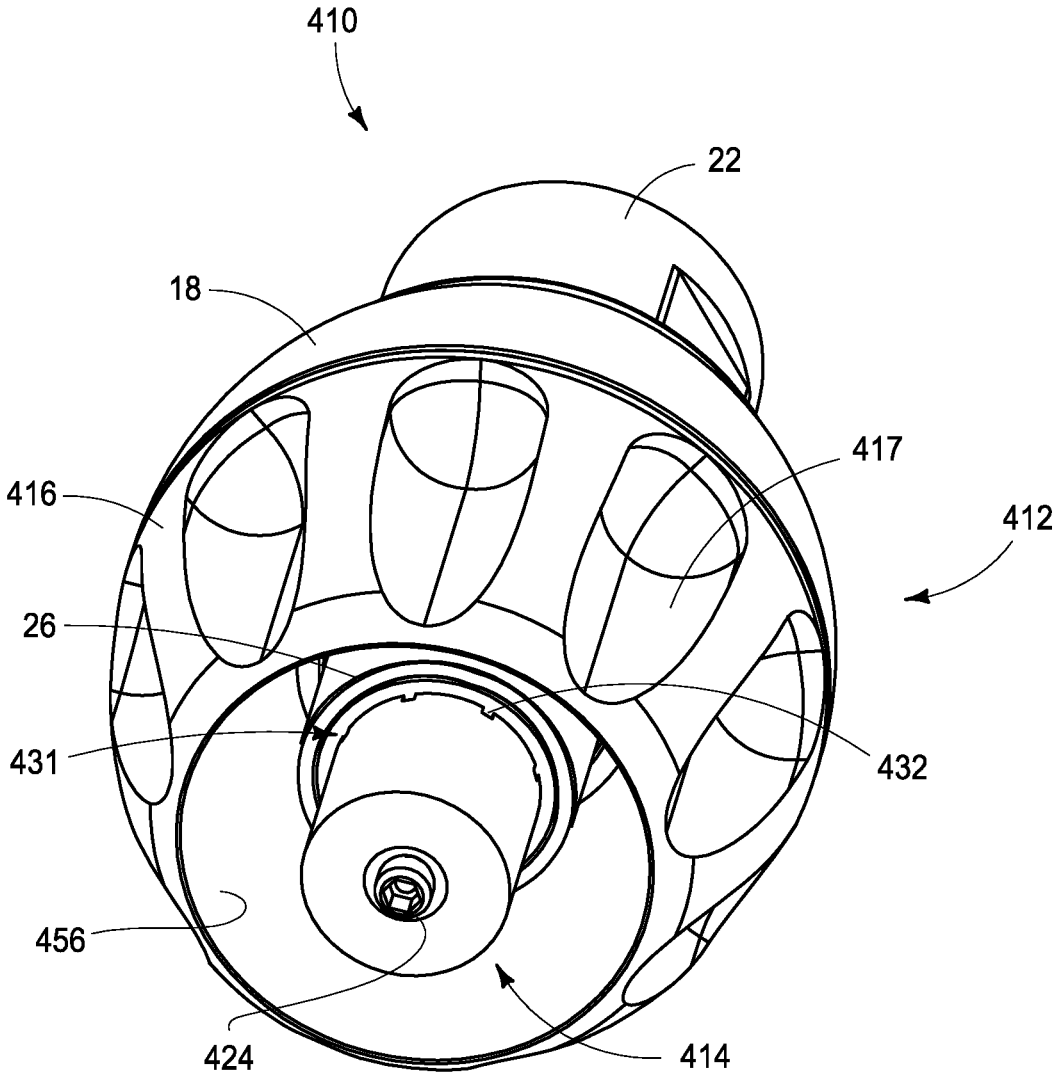
FIG. 37 is a perspective view illustrating even another showerhead.
Figure 38:
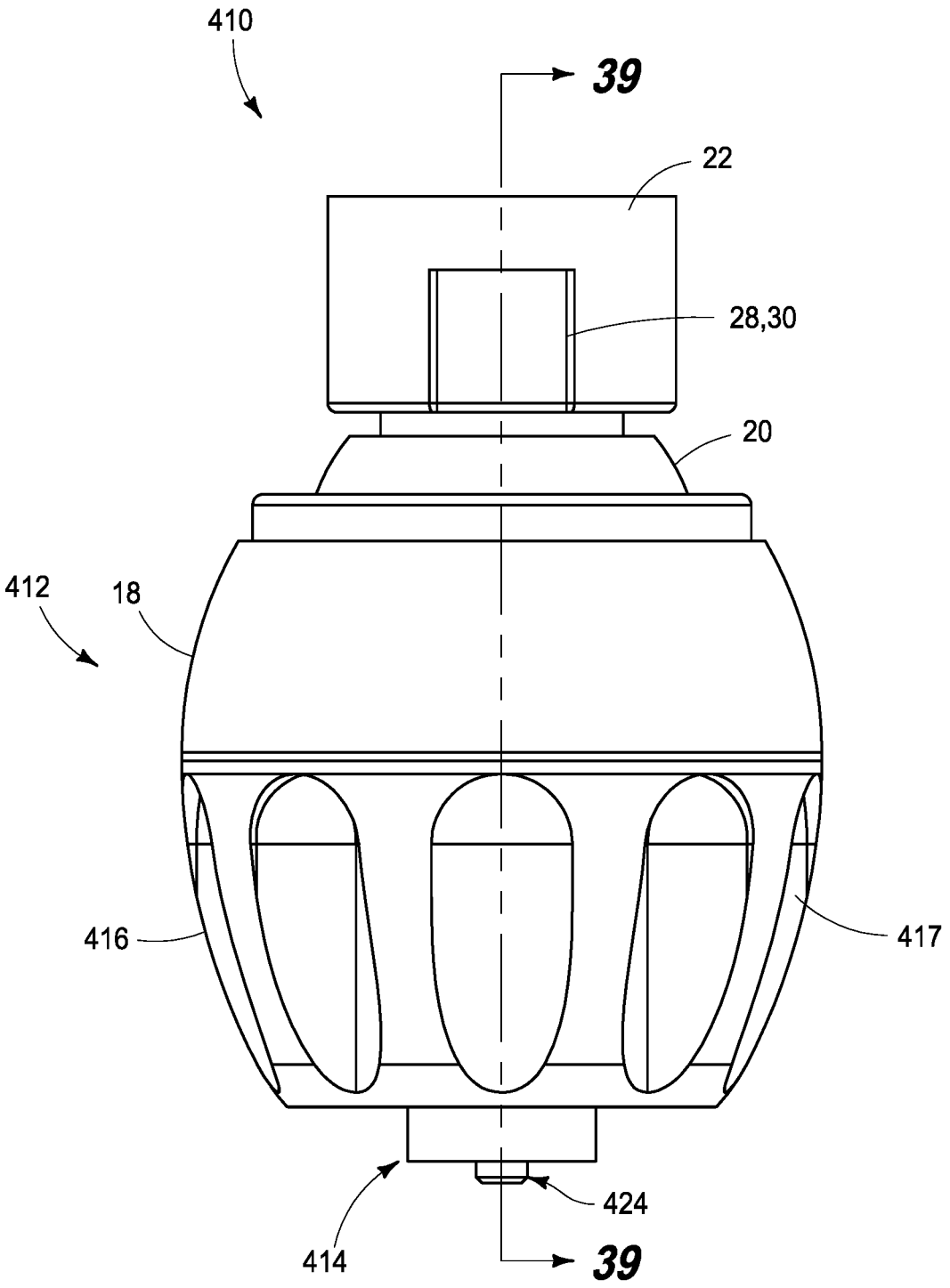
FIG. 38 is a side view of the showerhead of FIG. 37.

FIG. 37 is a perspective view illustrating even another showerhead 410 having a rotor, or spinner 414 that has an array 431 of fluid dispersing grooves, or slits 432 at an upstream end. Spinner 414 is carried for rotation via a threaded fastener 424 by mixing hub 26. Fluid is ejected from hub 26 in a spinning clockwise or counterclockwise direction (depending on direction of asymmetry provided in hub 26), impacting an upstream end of spinner 414 and ejecting from grooves 432 which are arranged so as to impart spinning to spinner 414. Ejected, spinning fluid, or spray then impacts an inner frustoconical surface 456 which further disperses and ejects fluid spray from showerhead 410. Housing 412 of showerhead 410 is formed from bell retainer 18 and fluted bell 416 having a circumferential array of equally spaced-apart flutes 417 provided in an outer surface, as shown in FIGS. 37 and 38. Housing 412 is pivotally affixed to ball end mount 22 and flutes 417 aid a using when gripping housing 412 to rotate angular position relative to ball 20 on ball end mount 22. Flat tool surfaces 28 and 30 aid in threading mount 22 onto a threaded pipe end (not shown). Downstream end of rotor 414 protrudes slightly from housing 412, along with threaded fastener 424.

Figure 39:
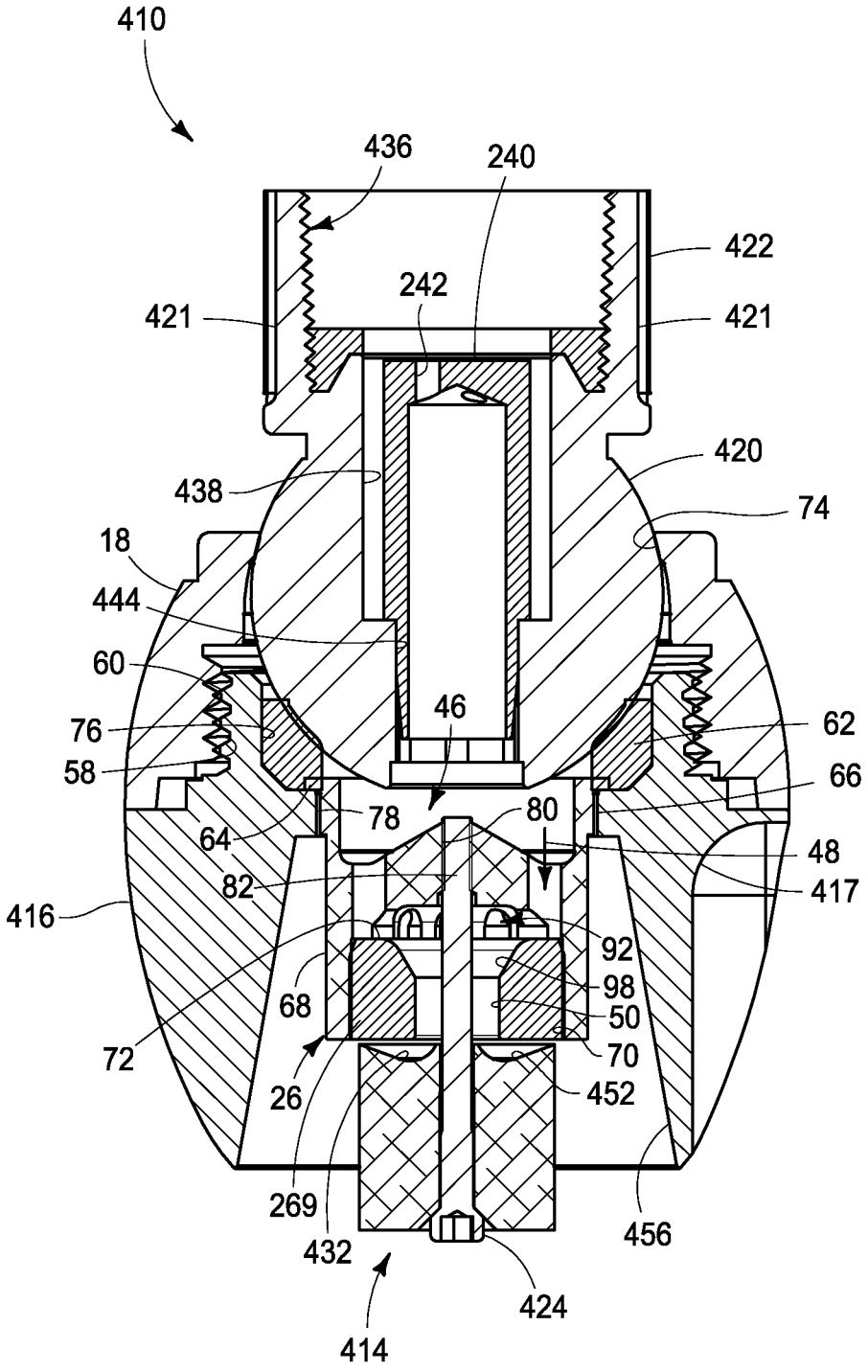
FIG. 39 is a centerline sectional view of the showerhead of FIGS. 38 and 39 taken along line 39-39 of FIG. 38.

FIG. 39 illustrates showerhead 410 in centerline sectional view. More particularly, water is delivered from a water supply line in a shower into ball end mount 422, within cylindrical bore 438, through apertures 242 in diffuser, or flow restrictor plug 240 from plug 240 into toroidal chamber 46, through radially inwardly extending passage 72, into centrally located common mixing chamber 92, into tapered frustoconical portion 98, and into cylindrical bore 50 where water is ejected under pressure in a swirling clockwise or counterclockwise direction (based on angular bias of passages 72). The ejected, swirling water impinges upon a toroidal segment surface 452 under pressure and spinning like a whirlpool, causing rotor 414 to spin. Grooves, or passages 432 provide escape paths for such fluid, imparting further forces on rotor 414 to induce spinning and ejection of fluid from rotor 414 into frustoconical surface 456 of bell 416. It is understood that an upstream end of rotor 414 as represented by surface 452 is spaced apart from a downstream end of nozzle body 68 as received in press-fit relation within bore 70 defining wall portion 68 of mixing hub 26.

Figure 42:
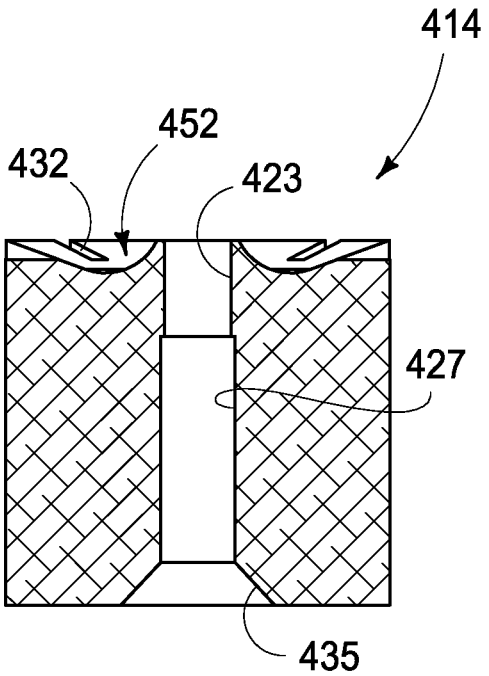
FIG. 42 is a centerline sectional view of the showerhead rotor of FIG. 40 taken along line 42-42 of FIG. 41.

As shown in FIGS. 39 and 42, rotor 414 has a reduced diameter bearing surface bore 423 and a frustoconical bearing surface recess 435 that engage for rotation against shaft and head portions of threaded fastener 424 (see FIG. 39). A male threaded end portion 82 of fastener 424 is received in threaded engagement within a complementarily female threaded portion 80 of hub 26. In assembly, ball 420 retains bell 416 via cylindrical flange 74 on bell retainer 18 in sealing, movable relation against flexible rubber gasket 62.

Flange 64 on hub 26 seats against a shoulder on bell 416 while cylindrical wall portion 66 is received in assembly within a complementary bore 78 in bell 416. Gasket 62 is received in cylindrical bore 76 within bell 416 and bell 416 is engaged via male threads 60 with female threads 58 of bell retainer 18. Finally, mount 422 is threaded via female threads 36 using a wrench or by hand tightening to engage longitudinal grooves 421 formed in a cylindrical outer surface of mount 422 onto a respective male threaded end portion of a water supply pipe, such as a shower water line outlet (not shown). Optionally, mount 422 can have any of a number of different connection interfaces, such as a male threaded portion, a quick disconnect portion, or any other suitable structure for affixing a showerhead in sealing relation with a water supply line.

Figure 40:
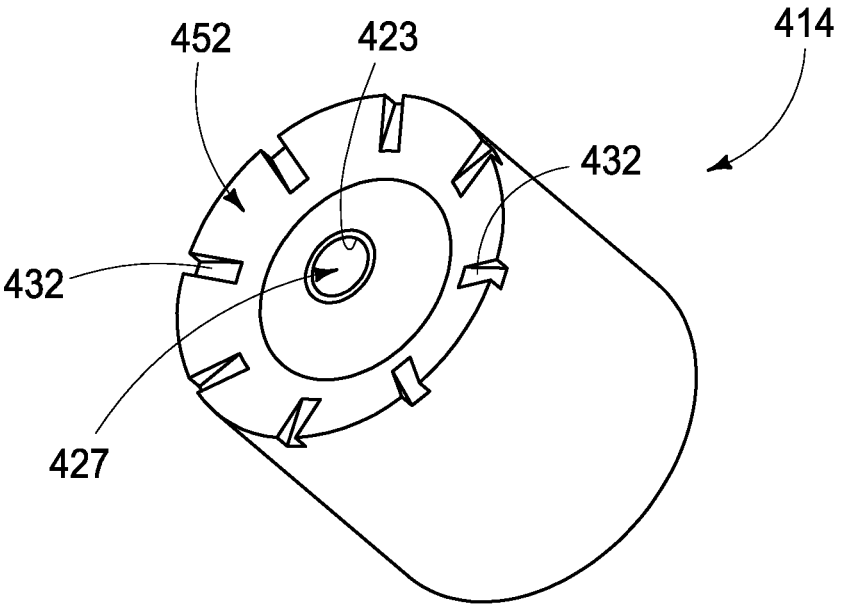
FIG. 40 is a perspective view from an upstream end of a showerhead rotor for the showerhead assembly of FIGS. 37-39.
Figure 41:
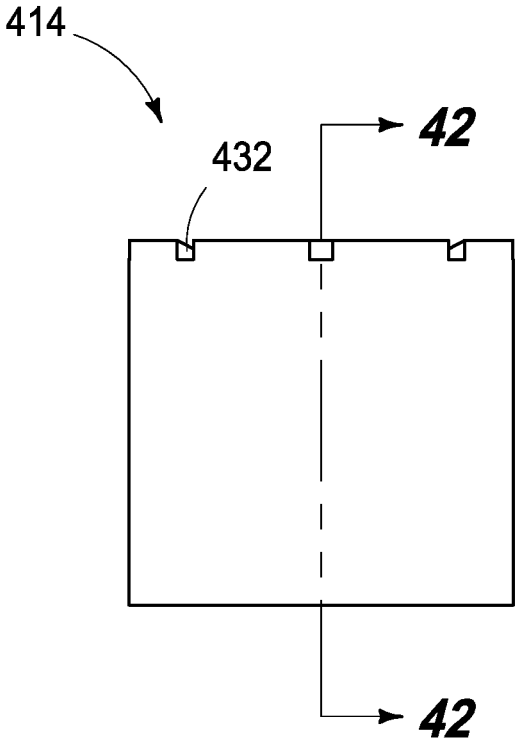
FIG. 41 is a side view of the showerhead rotor of FIG. 40.

FIG. 40 depicts an upstream end of showerhead rotor 414 for the showerhead assembly of FIGS. 37-39. More particularly, a radial array of slits, or fluid passages 432 are provided circumferentially spaced apart around central cylindrical bearing surface, or bore 423, providing an aperture 427 for receiving fastener 424 (see FIG. 39). As shown in FIGS. 40-42, slits 432 on rotor 414 are equally spaced apart around toroidal segment surface 452 and extend outwardly in a radial direction. Optionally, slits 432 and extend at one or more angles from a radial direction and/or slits 432 can be spaced apart unevenly around surface 452. As shown in FIG. 42, bore 427 is enlarged relative to bore 423 so as to reduce contact surface area with fastener 424 (see FIG. 39) in assembly so as to reduce contact friction therebetween and enhance rotation, particularly under low water pressure and flow conditions dictated by efforts to conserve water when taking a shower.

Figure 43:
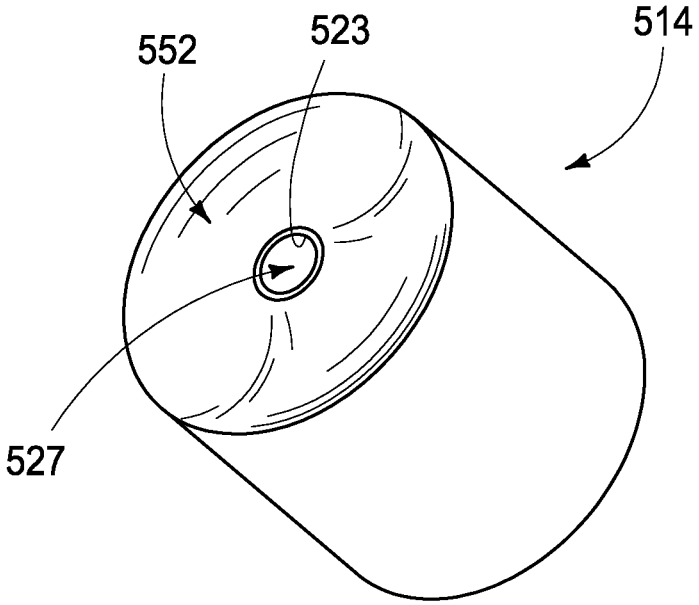
FIG. 43 is a perspective view from an upstream end of an alternative showerhead rotor, similar to the rotor depicted in FIG. 40, for use in the showerhead assembly of FIGS. 37-39.
Figure 44:
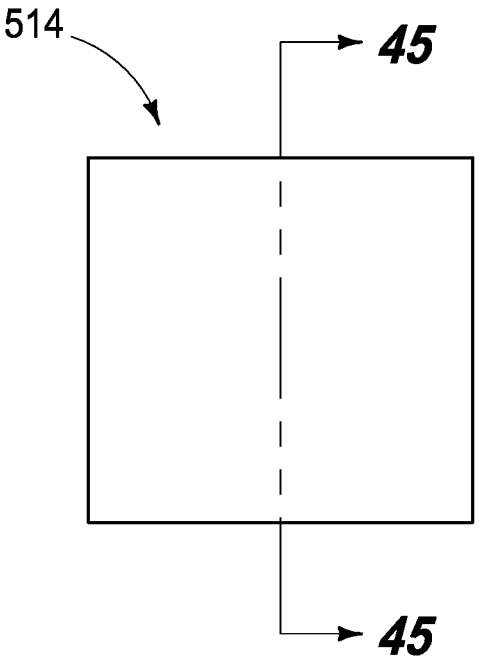
FIG. 44 is a side view of the showerhead rotor of FIG. 43.
Figure 45:
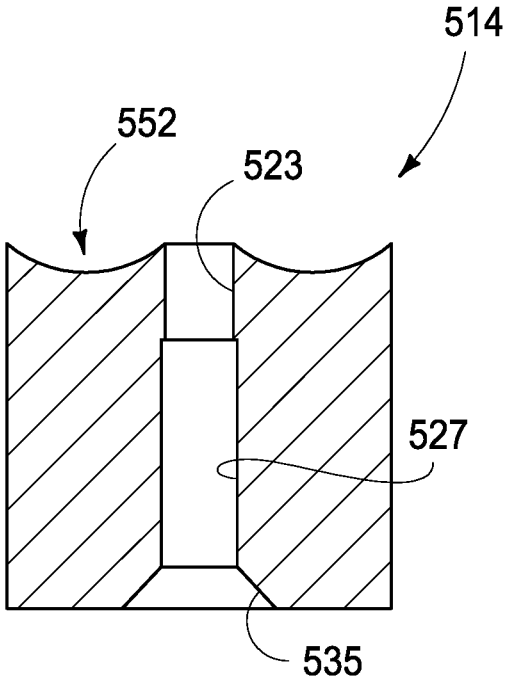
FIG. 45 is a centerline sectional view of the showerhead rotor of FIG. 43 taken along line 45-45 of FIG. 44.

FIG. 43 illustrates from an upstream end an optional showerhead rotor 514, similar to rotor 414 depicted in FIG. 40, for use in the showerhead assembly of FIGS. 37-39. More particularly, rotor 514 has a toroidal segment surface, or dished-out doughnut-shaped cavity 552 that is devoid of any slits, as shown in FIGS. 43 and 45. A pressurized swirling output of water impinges on surface 552 to impart, in some cases, motion to rotor, or fluid dispersion body 514 where forces overcome frictional forces between surface 523 and 535 with fastener 424 (see FIG. 39). In other cases, rotor 514 does not spin, but instead acts as a fluid dispersion surface. Aperture 527 has an enlarged bore portion 527 that serves to reduce contact surface area of surface 523 between rotor 514 and fastener 424 (see FIG. 39).

Figure 46:
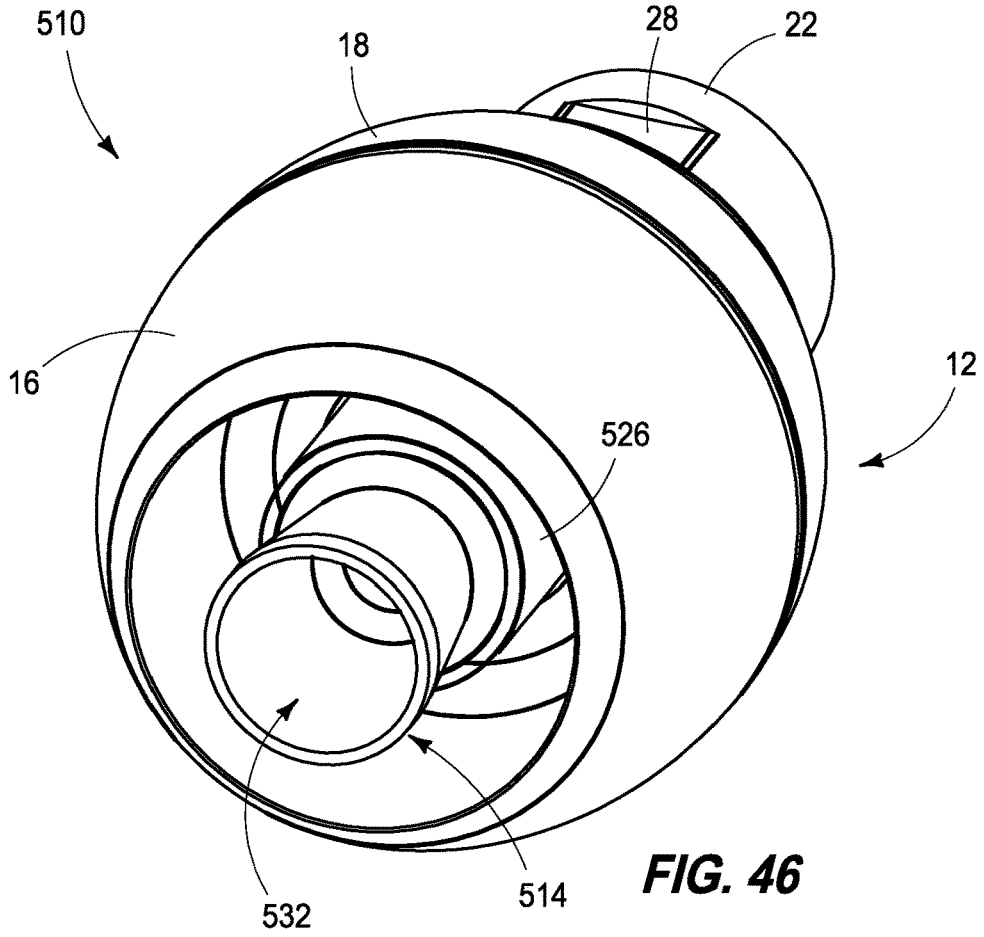
FIG. 46 is a perspective view illustrating yet even another showerhead.
Figure 46A:
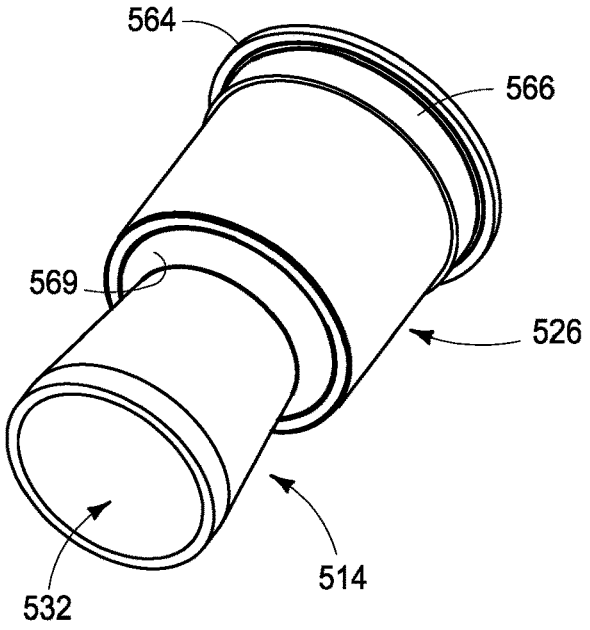
FIG. 46A is a component perspective view of a fluid hub and diverging conical nozzle from the showerhead of FIG. 46.

FIGS. 46-59 illustrate yet even another showerhead 510 where a diverging cone, or expansion nozzle 514 ejects spinning, ejecting water from the showerhead 510 via a diverging conical outlet port 532. Details of showerhead 510 are similar to showerhead 10 of FIGS. 1-19, except that rotor 14 has been eliminated and mixing hub 526 is essentially the same as mixing hub 26 (see FIGS. 1-19), save for elimination of threaded bore 80. Water is directed into a spinning whirlpool, or rapidly rotating mass of water, through a perforate partition, or baffle, provided in the housing of mixing hub 526 as depicted in FIGS. 46 and 46A. Housing 12 and ball end fitting 22 of showerhead 510 remain essentially the same as housing 12 and ball end fitting 22 in FIGS. 1-3, with bell 16, bell retainer 18, and flat tool surfaces 28 and 30 (see FIG. 47) being common with the prior version.

As shown in FIG. 46A, expansion nozzle, or cone 514 is integrally formed with cylindrical nozzle body 569. Body 569 is press-fit into wall portion 568 of mixing hub 526 (see FIG. 48). Similar to mixing hub 26 (of FIGS. 1-3), mixing hub 526 has a cylindrical flange portion 564 and an increased diameter cylindrical wall portion 566. As shown in side view in FIG. 47, expansion nozzle 514 extends beyond housing 12, as does ball 20 at an opposite end.

Figure 48:
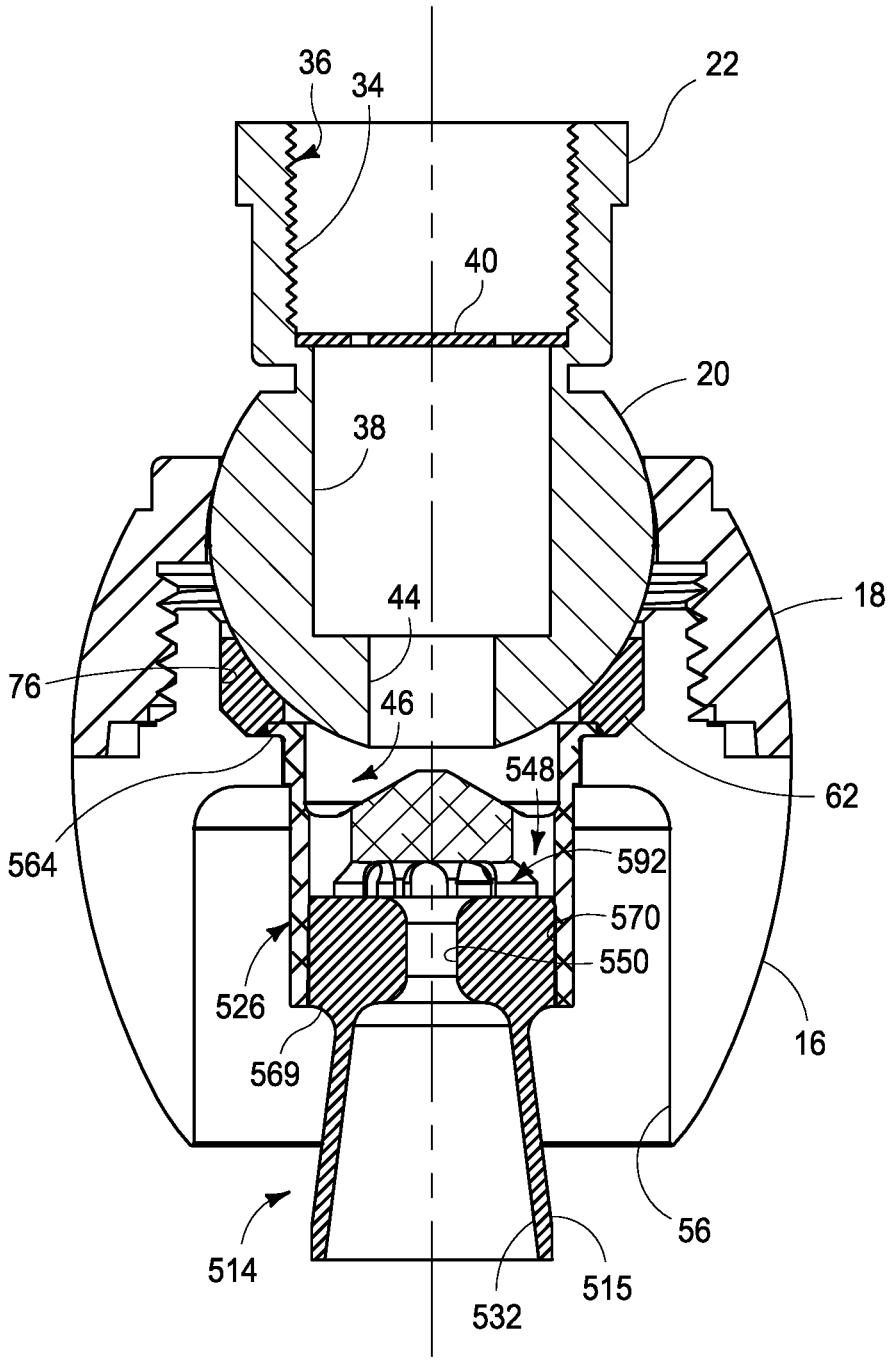
FIG. 48 is a centerline sectional view of the showerhead of FIGS. 46 and 47 taken along line 48-48 of FIG. 47.

FIG. 48 shows showerhead 510 in centerline sectional view. Expansion nozzle 514 is formed integrally with a diverging cone 515 and a cylindrical nozzle body 569 and is provided centrally within cylindrical bore 56. An inner frustoconical surface 532 of cone 515 receives a highly energized supply of swirling fluid, or water from bore 550 by way of passage through threaded bore 36, diffuser plate 40, cylindrical bores 38 and 44, toroidal chamber 46, peripheral ports 548, peripheral passage 572, and common mixing chamber 592. Mixing hub 526 is operative to mix and swirl fluid in chamber 592 as a result of the radially angled orientation of peripheral passages 572 (see FIG. 50). Ball end fitting 20 on ball end mount 22 affixes with threads 34 to a threaded end portion of a water supply line (not shown) and bell 16 and bell retainer 18 entrap ball 20 in assembly in sealing, pivotally repositionable engagement with rubber gasket 62 in cylindrical gasket seat 76. A flange portion 564 of hub 526 seats with bell 16 and seals against gasket 62 in assembly. An outer diameter of nozzle body 569 is urged into press-fit assembly within a cylindrical bore 570 of hub 526.

As shown in FIGS. 49-53, mixing hub 526 delivers fluid under line pressure from an upstream end (see FIGS. 49 and 51) to a downstream end (see FIGS. 50 and 53) through fluid ports, or passages 548. More particularly, fluid passes under line pressure from an upstream end through axially extending fluid ports 548 into angled and radially inwardly directed peripheral fluid passages 572 (see FIGS. 50 and 53). Hub 526 omits hole 80 provided in hub 26 (of FIG. 3), but it is understood that one alternative construction includes such hole and uses hub 26 in place of hub 526. In such case, fastener 24 is omitted and water merely passes through hole 80. Furthermore, showerhead 910 of FIG. 63 can optionally omit such hole in the hub. As viewed from a downstream end and shown in FIGS. 50 and 53, fluid passages 572 induce clockwise swirling and mixing of fluid from passages 572 within mixing cavity, or chamber 592 (see FIGS. 50 and 53). Optionally, passages 572 can be oriented to induce swirling in a counterclockwise direction. Further optionally, some or all of passages 572 can be configured to extend solely in a radially inward direction.

Figure 49:
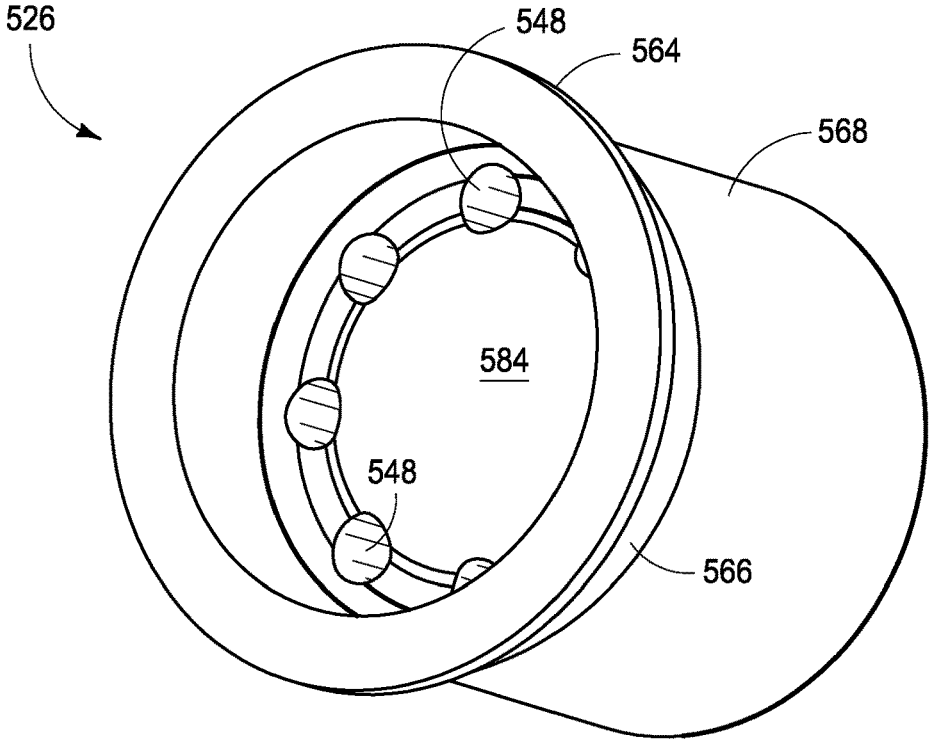
FIG. 49 is a perspective view of a fluid hub from the showerhead of FIGS. 46-48 taken from an upstream end.
Figure 50:
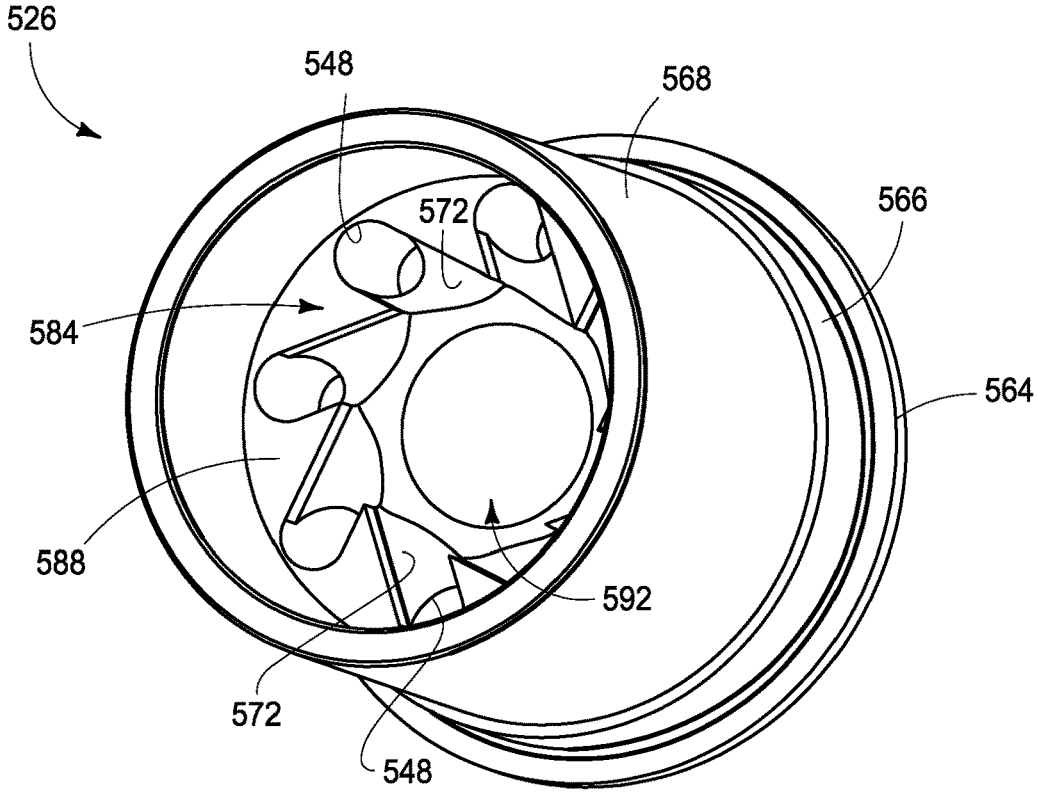
FIG. 50 is a perspective view of a fluid hub from the showerhead of FIGS. 46-48 taken from a downstream end.
Figure 51:
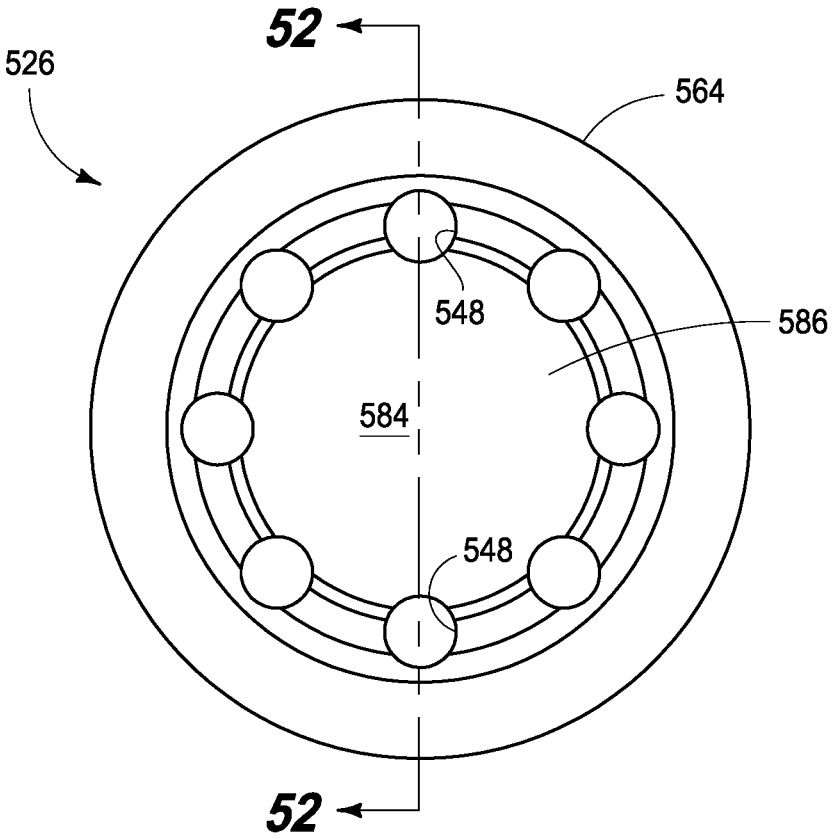
FIG. 51 is an upstream end view of the fluid hub of FIGS. 46-48.
Figure 52:
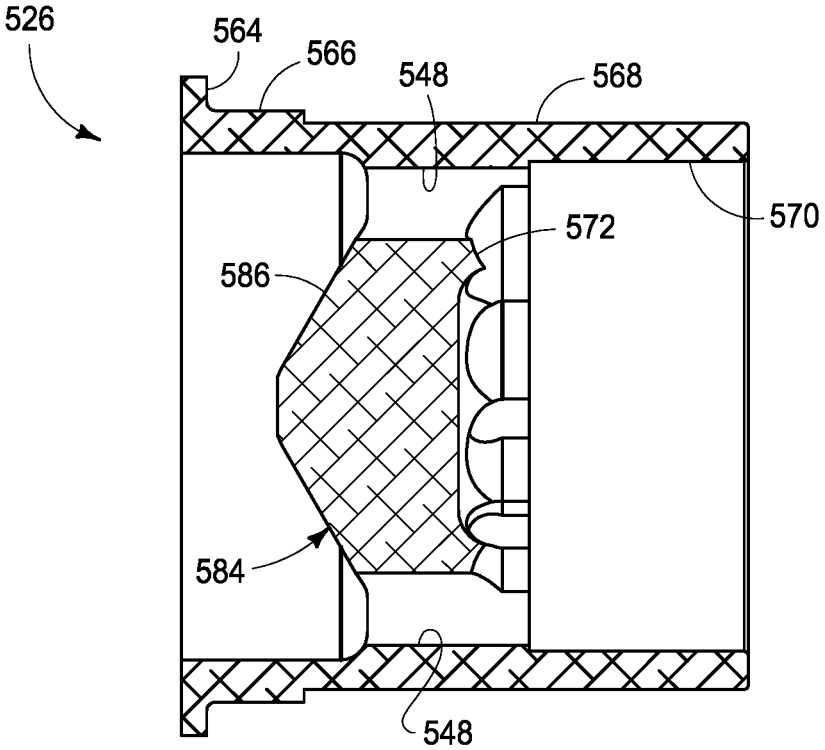
FIG. 52 is a centerline sectional view of the fluid hub taken along line 52-52 of FIG. 51.
Figure 53:
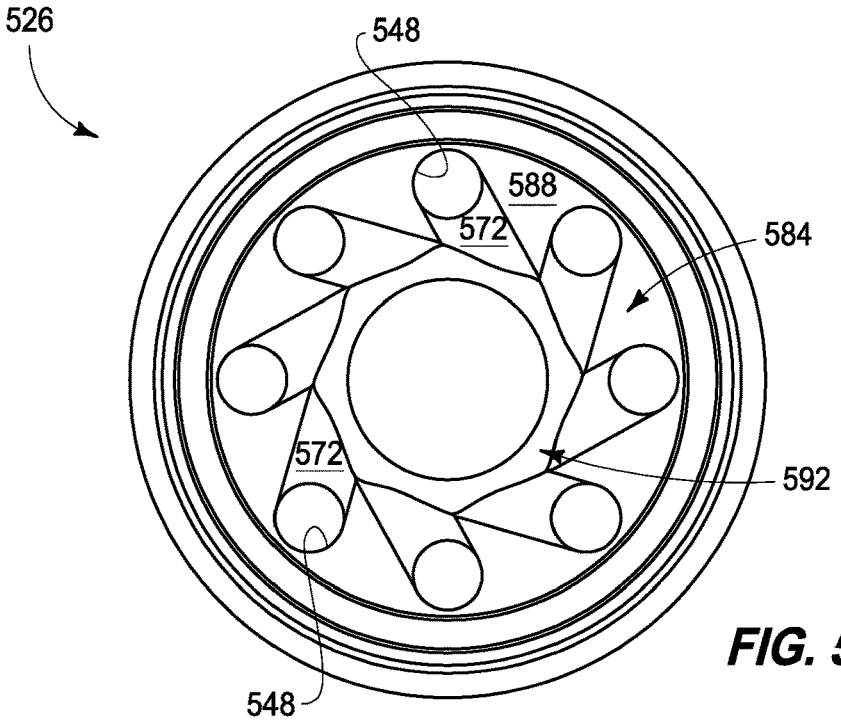
FIG. 53 is a downstream end view of the fluid hub of FIGS. 49-52.

As shown in FIGS. 49 and 51, ports 548 extend axially through cylindrical baffle 584 and are equally spaced apart circumferentially in a cylindrical array about an outer periphery of baffle 584. As shown in FIGS. 51 and 52, baffle 584 has a conically-shaped upstream inlet surface, as well as a flat outlet surface 588 (see FIGS. 50 and 53). Mixing chamber 592 is provided radially inwardly of surface 584, as shown in FIGS. 50 and 53. Flange portion 564, wall portion 566 and wall portion 568 encircle an interior region within hub 526 divided by baffle 584 into an upstream end and a downstream end, as shown in FIGS. 49-52. FIG. 52 illustrates upstream end encircled by flange portion 564, wall portion 566, and an upstream segment of wall portion 568 and bounded by conical inlet surface 586 of baffle 584, while the downstream end is encircled by a downstream segment of wall portion 568. Fluid enters peripheral ports 548 in an axial direction, then turns generally radially inwardly along peripheral passages 572. Cylindrical bore 570, according to one construction, is sized to receive an outer diameter surface of nozzle body 569 (see FIG. 54) in press-fit relation.

Figure 54:
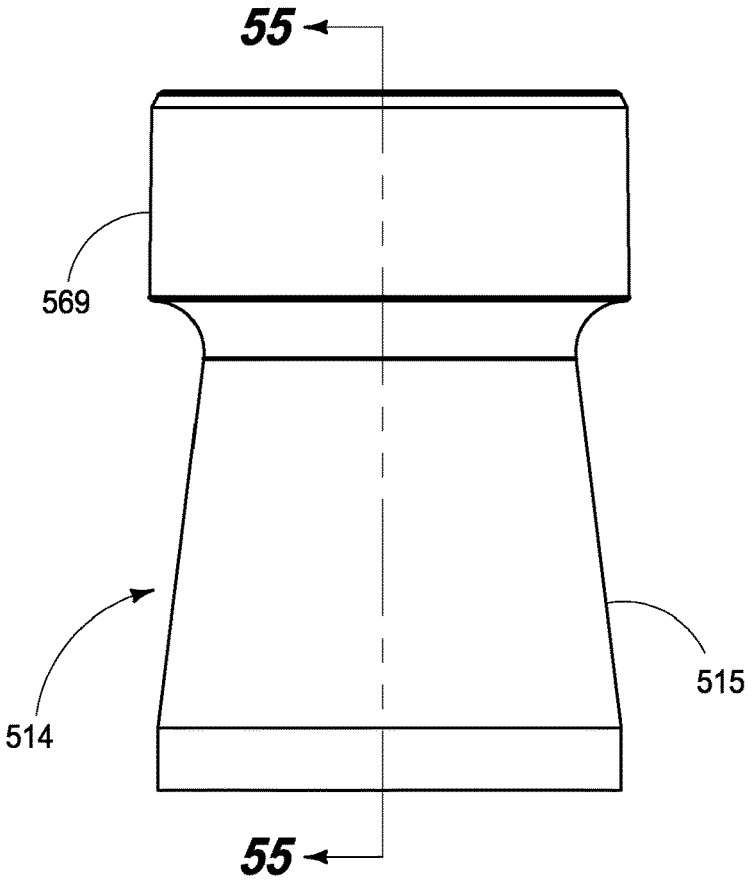
FIG. 54 is a side view of a nozzle body insert used in the showerhead of FIGS. 46-48.
Figure 55:
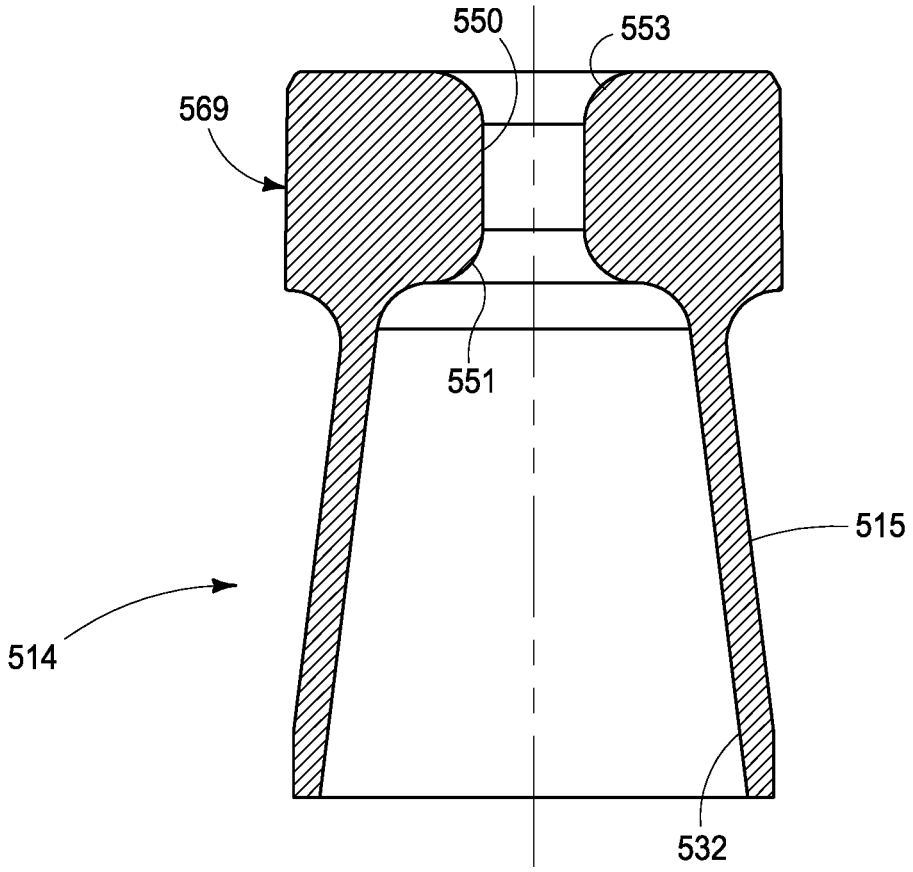
FIG. 55 is a centerline sectional view of the nozzle body insert taken along line 55-55 of FIG. 54.

FIGS. 54 and 55 illustrate a unitary construction of expansion nozzle 514, including cylindrical nozzle body portion 569 integrally formed with diverging cone 515.

Additionally, cylindrical bore 550 of nozzle 514 has a flared expansion outlet 551 and a flared compression inlet 553. Water is ejected from mixing hub 526 under pressure with speed and induced to swirl. Such ejected swirling fluid is passed through bore 550 and expended and directed through a frustoconical inner surface 532 of diverging cone 515.

Figure 47:
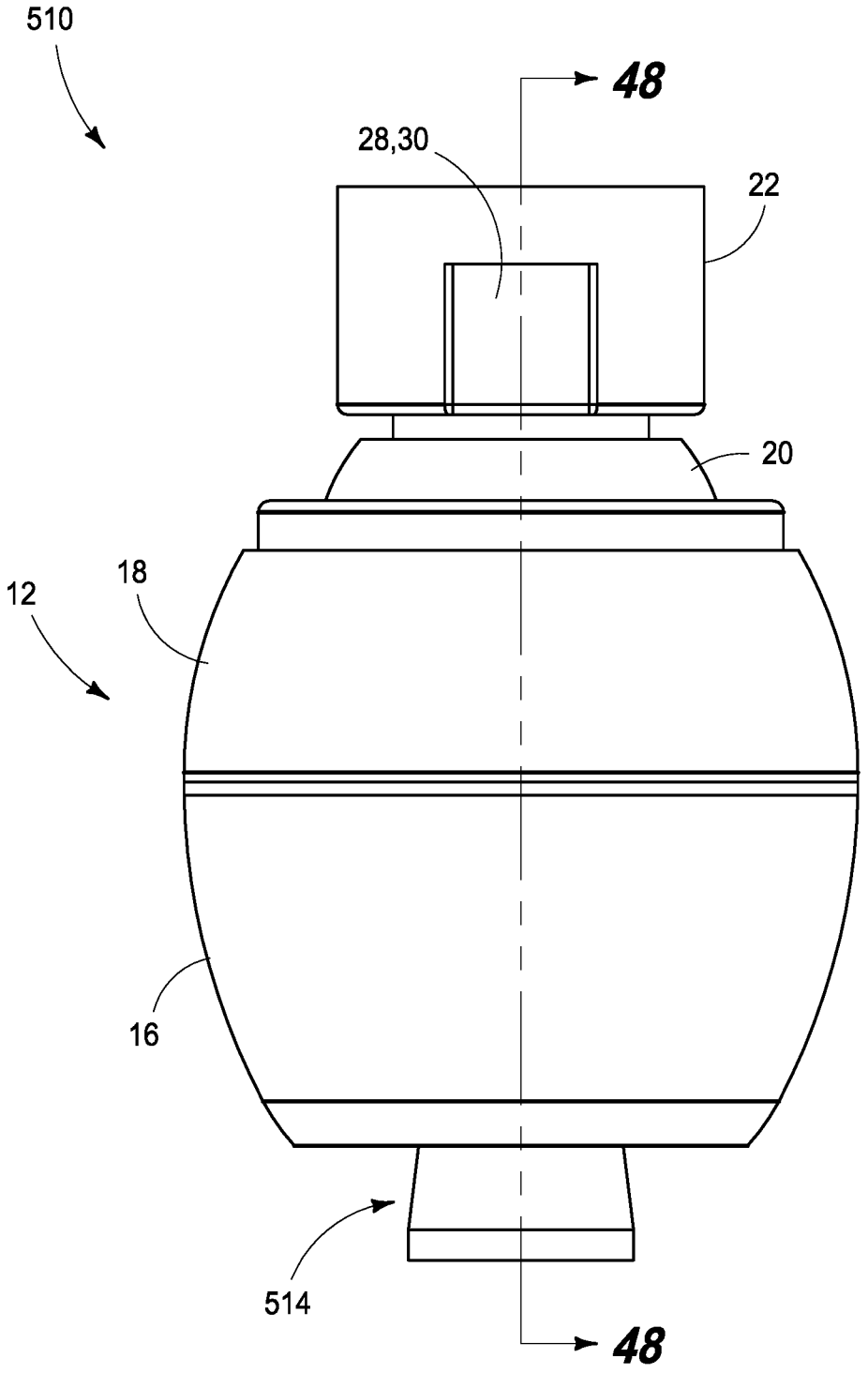
FIG. 47 is a side view of the showerhead of FIG. 46.
Figure 56:
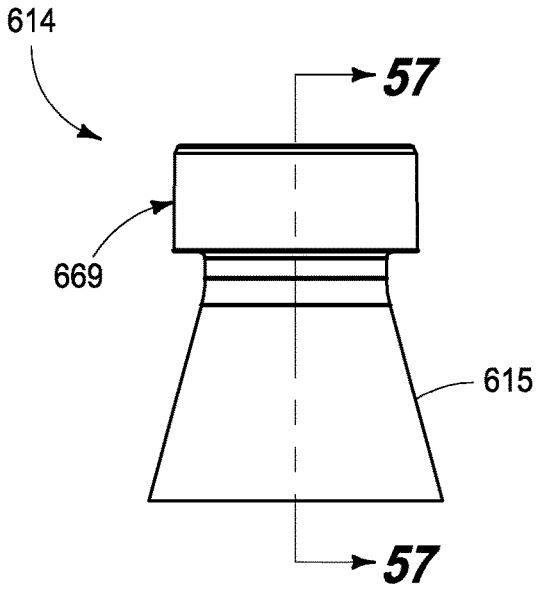
FIG. 56 is an optional nozzle for the shower head of FIGS. 46-48 where perturbations, or interruptions are provided on an inner conical surface of the diverging cone nozzle
Figure 57:
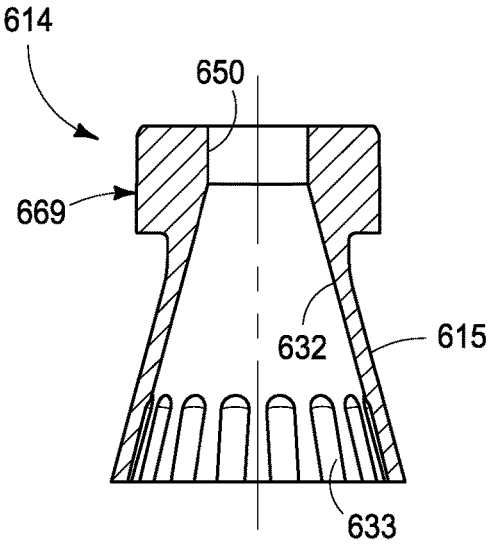
FIG. 57 is a centerline sectional view taken along line 57-57 of FIG. 56.

FIGS. 56-57 illustrate an optional nozzle 614 for the showerhead of FIGS. 46-48 where perturbations, or interruptions 633 are provided on an inner conical surface 632 of the diverging cone nozzle 615. Cylindrical nozzle body portion 669 is received in press-fit assembly within bore 570 of wall portion 568 on hub 526 (see FIG. 48). Interruptions 633 comprise semi-cylindrical grooves formed in surface 632. Optionally, other forms of concave or convex structures can be provided to interrupt the flow of swirling fluid being ejected from bore 650 through conical surface 632 such as splines, ribs or even angled grooves or ridges. Such interruptions serve to further break up and disperse the swirling and ejecting fluid as it expands and passes out of conical surface 632.

Figure 58:
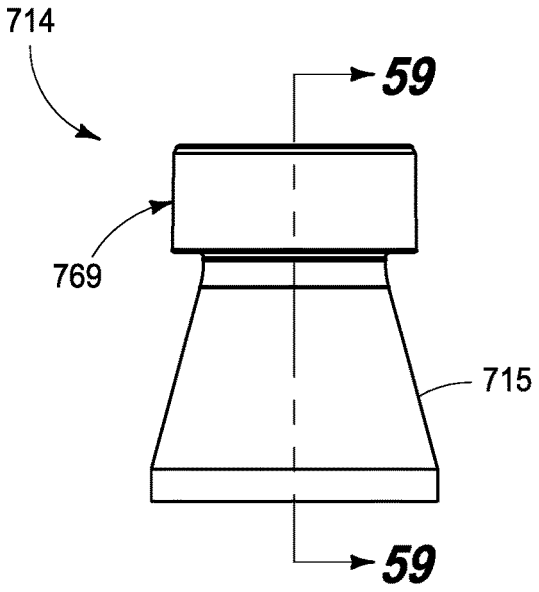
FIG. 58 is a second optional nozzle for the shower head of FIGS. 46-48 where the diverging cone nozzle has a converging segment upstream of the diverging cone
Figure 59:
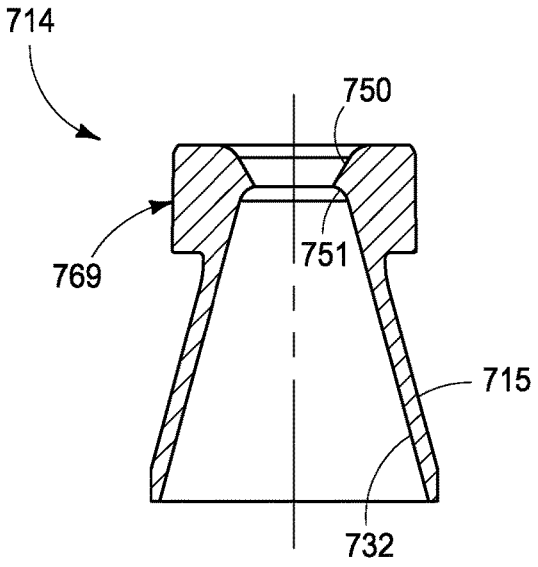
FIG. 59 is a centerline sectional view taken along line 59-59 of FIG. 58.

FIGS. 58-59 illustrate a second optional nozzle 714 for the showerhead of FIGS. 46-48 where the diverging cone nozzle 715 has a converging segment 750 upstream of the diverging cone 732. Cylindrical nozzle body portion 769 is received in press-fit assembly within bore 570 of wall portion 568 on hub 526 (see FIG. 48). A circumferential lip edge 751 provides a sharp transition from converging segment 750 and diverging cone 732, as shown in FIG. 59. Edge 751 provides a constriction that serves, at least in part, to accelerate fluid flow past edge 751 where it expands downstream into diverging cone 732.

FIG. 60 is a Table of test results detailing water line pressures and flow rates for the embodiments of FIGS. 1-19, FIGS. 46-48, and an exemplary prior art showerhead, a Waxman Model No. 7651000T, sold by Waxman, 24460 Aurora Road, Bedford Heights, Ohio 44146. and having UPC 28905765107.

FIG. 61 is a Table of test results detailing water line pressures and flow rates for the embodiments of FIGS. 1-19 and FIGS. 46-48 while incorporating three uniquely different flow restrictor plates.

Figure 62:
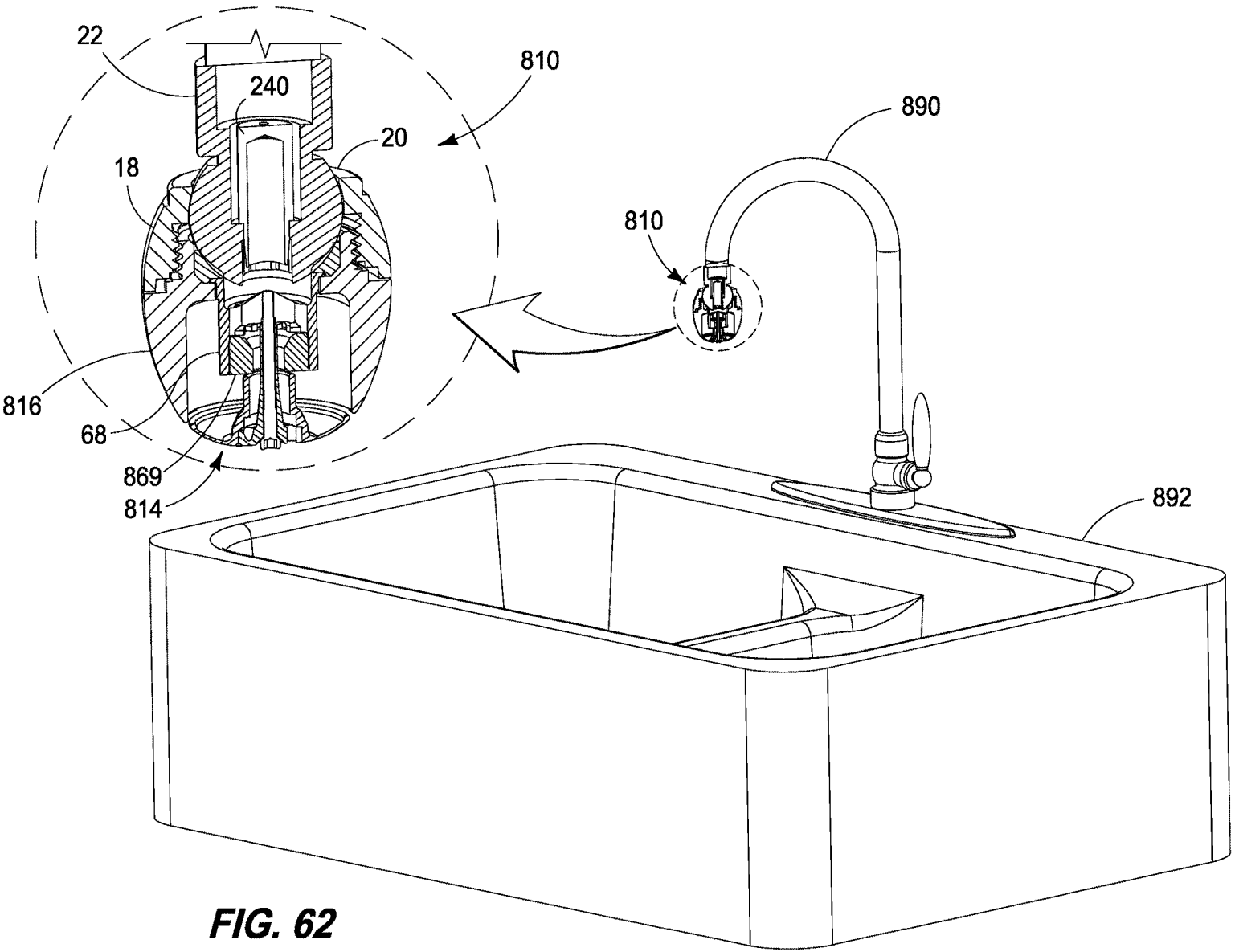
FIG. 62 is a perspective view illustrating a sink faucet similar to the showerhead depicted in the embodiment of FIGS. 20-22.

FIG. 62 is perspective view illustrating a kitchen sink 892 having a faucet 890 with a spray head 810 similar to the showerhead depicted in the embodiment of FIGS. 20-22, but scaled down in size. More particularly, spray head 810 is shown in greater detail in an enlarged inset circle having parts common with showerhead 210 (of FIGS. 20-22). For example, ball end 20, ball end mount 22, flow restrictor plug 240, bell 816, bell retainer 18, wall portion 68, nozzle body 869 and rotor 814 are constructed in a manner similar to corresponding parts on showerhead 210 (of FIGS. 20-22).

Figure 63:
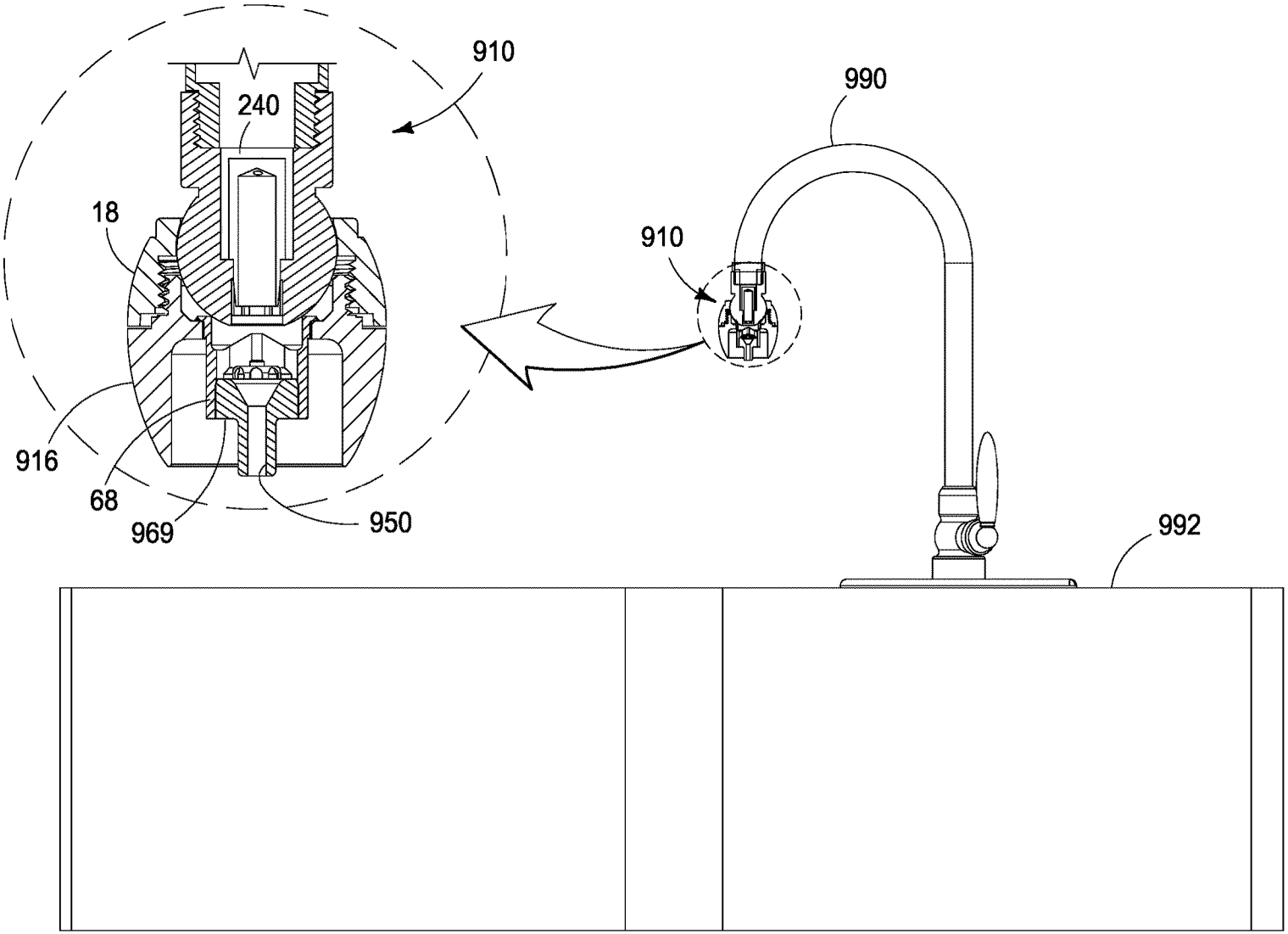
FIG. 63 is a perspective view illustrating another sink faucet having a hub with a straight nozzle body insert.

FIG. 63 is a side view illustrating a kitchen sink 992 having another faucet 990 with a spray head 910 having a straight nozzle body insert 950. More particularly, nozzle body insert 950 is press-fit via cylindrical nozzle body 969 within a complementary bore in cylindrical wall portion 68, as shown in an enlarged inset circle. Flow restrictor plug 240, bell 916, bell retainer 18, wall portion 68, and nozzle body 969 are constructed in a manner similar to corresponding parts on showerhead 210 (of FIGS. 20-22). Bore 950 comprises a cylindrical bore that receives swirling water under pressure from wall portion 68 of the mixing hub.

As shown herein, it is understood that the showerheads and showerhead components depicted in FIGS. 1-63 have been detailed using engineering drawings that have a 1:1 scale in the X and Y axes as shown in FIGS. 2-4, 7-15, 17-19, 21-32, 34-36, 38-39, 41-42, 44-45, 47-48, 51-59, and 62-63. It is also understood that various components are interchangeable amongst versions.

Optionally, other constructions are understood.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A showerhead, comprising:

a housing having a fluid inlet and a fluid outlet;

a circumferential mixing hub having a baffle, a plurality of axially extending peripheral ports in the baffle upstream and in fluid communication with a plurality of radially inwardly extending passages, at least one of the passages extending at an angle relative to a radial direction to a central mixing chamber so as to impart one of a clockwise and a counterclockwise direction mixing and swirling of water within the mixing chamber;

a nozzle body downstream and coaxial with the central mixing chamber having an outer circumferential surface configured to receive swirling fluid from the central mixing chamber and defining at least in part an annular swirling cavity having an upstream portion greater in cross sectional area than a downstream portion;

a fastener affixed to the hub coaxially within the circumferential swirling cavity to provide a center support post carried by the hub centrally of the central mixing chamber and the annular swirling cavity; and a rotor carried for rotation about the fastener coaxially within the nozzle body having an inner circumferential surface of the annular swirling cavity and at least one fluid ejecting outlet aperture spaced radially outwardly of a central axis of the fastener and angled relative the central axis to impart spin to the rotor responsive to fluid ejecting from the at least one outlet.

2. The showerhead of claim 1, further comprising a coupler communicating with the fluid inlet and adapted for connection to a water supply pipe.

3. The showerhead of claim 1, wherein the housing comprises a cylindrical body having a surface of revolution mixing cavity.

4. The showerhead of claim 3, wherein the mixing cavity comprises an end portion of an oblate spheroid.

5. The showerhead of claim 3, wherein each of the plurality of radially inwardly extending passages provides a slot that extends in a radially inward direction.

6. The showerhead of claim 5, wherein a plurality of the slots form an array of substantially radially extending and circumferentially spaced apart slots.

7. The showerhead of claim 6, wherein at least one of the slots extends at an angle relative to a radially inward direction.

8. The showerhead of claim 5, wherein the peripheral slots form an array of inwardly extending, angularly offset from a radial direction, and circumferentially spaced apart peripheral slots.

9. The showerhead of claim 1, wherein the housing comprises a tubular body.

10. The showerhead of claim 9, wherein the tubular body has a cavity provided at a downstream end.

11. The showerhead of claim 10, wherein the cavity comprises a cylindrical bore.

12. The showerhead of claim 10, wherein the nozzle body has an outer surface sized to fit in interference fit within the cavity.

13. The showerhead of claim 10, wherein the nozzle body is sized to be received within the cavity with a self-retaining fit-up.

14. The showerhead of claim 1, wherein the nozzle body comprises a tubular member having a through-passage.

15. The showerhead of claim 14, wherein the through-passage comprises an axial bore.

16. The showerhead of claim 14, wherein the through-passage comprises an aperture.

17. The showerhead of claim 15, wherein the through passage comprises an axial cylindrical bore.

18. The showerhead of claim 14, wherein the through passage comprises a smooth inner wall portion free from any perceptible projections, lumps or indentations sufficient to interrupt fluid flow.

19. The showerhead of claim 1, wherein the nozzle body comprises a compression chamber.

20. The showerhead of claim 1, wherein the center support post comprises a retention head configured to retain the rotor for rotation about a central shaft of the fastener.

21. The showerhead of claim 20, wherein the elongate fastener has a threaded end portion and the baffle comprises a complementary threaded aperture sized to receive the threaded end portion.

22. The showerhead of claim 1, wherein the rotor comprises an outer housing and a central insert portion, the at least one fluid ejecting outlet aperture provided by at least one of the outer housing and the central insert portion.

23. The showerhead of claim 1, wherein the rotor comprises a circumferential array of the fluid ejecting outlet apertures.

24. The showerhead of claim 23, wherein at least one of the fluid ejecting outlet apertures is angled in a direction perpendicular to a radial direction of the rotor.

25. The showerhead of claim 23, wherein all of the fluid ejecting outlet apertures extend solely in one of an axial direction and a radial direction.

26. A showerhead, comprising:

a housing having a fluid inlet and a fluid outlet;

a circumferential mixing hub having a plurality of axially extending peripheral ports in the hub upstream and each port provided in fluid communication with a respective passage extending radially inwardly, at least one passage provided at an angle relative to a radial direction to a central mixing chamber so as to impart one of a clockwise and a counterclockwise direction mixing and swirling of water within the mixing chamber;

a nozzle body carried by the housing downstream of the mixing chamber having an annular swirling cavity downstream of the central mixing chamber having an inlet end greater in cross sectional area than a downstream cross sectional area;

a center support post carried by the hub centrally of an outlet chamber and through a flow concentrating outlet; and a rotor carried for rotation coaxial and downstream of the nozzle body by the center support post and having an inner circumferential surface of the annular swirling cavity and at least one fluid ejecting outlet aperture spaced radially outwardly of a central axis of the rotor and angled relative the central axis to impart spin to the rotor responsive to fluid ejecting from the at least one outlet.

27. The showerhead of claim 26, wherein the housing comprises a cylindrical body having a surface of revolution mixing cavity.

28. The showerhead of claim 27, wherein the mixing cavity comprises an end portion of an oblate spheroid.

29. The showerhead of claim 27, wherein at least one of the slots extends in a radially inward direction.

30. The showerhead of claim 29, wherein the passages form an array of substantially radially extending and circumferentially spaced apart slots.

31. The showerhead of claim 27, wherein at least one of the passages extends at an angle relative to a radially inward direction.

32. The showerhead of claim 27, wherein the passages form an array of inwardly extending, angularly offset from a radial direction, and circumferentially spaced apart slots.

33. The showerhead of claim 26, wherein the rotor comprises an outer housing and a central insert portion, the at least one fluid ejecting outlet aperture provided by at least one of the outer housing and the central insert portion.

34. The showerhead of claim 33, wherein the central insert portion is mounted coaxially within an expansion chamber of the outer housing.

35. The showerhead of claim 26, wherein the rotor comprises a radially-outwardly extending groove provided in the frustoconical feed cavity proximate a distal end of the rotor operative to inhibit backsplash of fluid between the rotor and the nozzle body.

36. The showerhead of claim 26, wherein the rotor comprises a circumferential array of fluid ejecting outlet apertures.

37. The showerhead of claim 36, wherein at least one of the fluid ejecting outlet apertures is angled in a direction perpendicular to a radial direction of the rotor.

38. The showerhead of claim 36, wherein all of the fluid ejecting outlet apertures extend solely in one of an axial direction and a radial direction.

39. The showerhead of claim 1, further comprising a compressing annular cavity formed between an inner bore or the rotor and a tapering outer surface of the rotor configured to narrow in cross sectional area from an inlet end to an outlet end of the compressing annular cavity.

40. The showerhead of claim 39, further comprising a radially enlarged annular cavity downstream of the compressing annular cavity configured as a backsplash preventer.

41. The showerhead of claim 26, wherein the rotor is provided in spaced, non-contact relation with the nozzle body.

* * * * *